US007375735B2

(12) United States Patent
Asao

(10) Patent No.: US 7,375,735 B2
(45) Date of Patent: May 20, 2008

(54) DISPLAY APPARATUS AND IMAGE FORMING APPARATUS

(75) Inventor: Yasufumi Asao, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 468 days.

(21) Appl. No.: 11/165,168

(22) Filed: Jun. 24, 2005

(65) Prior Publication Data

US 2006/0017750 A1 Jan. 26, 2006

Related U.S. Application Data

(63) Continuation of application No. PCT/JP2005/008733, filed on May 6, 2005.

(30) Foreign Application Priority Data

May 6, 2004 (JP) ..... 2004-137503
Apr. 28, 2005 (JP) ..... 2005-132019

(51) Int. Cl.
*G09G 5/10* (2006.01)

(52) U.S. Cl. ..... 345/690; 345/214

(58) Field of Classification Search ..... 345/87–100, 345/204–215, 690–698; 349/12, 96–113; 348/488, 752
See application file for complete search history.

(56) References Cited

U.S. PATENT DOCUMENTS 5,796,378 A 8/1998 Yoshida et al.
5,999,160 A * 12/1999 Kitamura et al. ..... 715/500.1
6,008,783 A * 12/1999 Kitagawa et al. ..... 345/39
6,014,195 A 1/2000 Sakamoto et al.
7,142,188 B2 * 11/2006 Tsumura et al. ..... 345/102

(Continued)

FOREIGN PATENT DOCUMENTS

JP 3098112 4/1991

(Continued)

OTHER PUBLICATIONS

Y. Asao, et al., "34.3: Quasi- and Analog-Full Color Displaying Methods with High Light Efficiency in Super-High-Resolution LCDs", SID International Symposium Digest of Technical Papers, vol. XXXV, Book II, pp. 1110-1113 (May 2004).

(Continued)

*Primary Examiner*—Nitin I. Patel
(74) *Attorney, Agent, or Firm*—Fitzpatrick, Cella, Harper & Scinto

(57) ABSTRACT

A display apparatus includes a display panel including a plurality of pixels exhibiting a brightness change range with respect to an applied voltage and a hue change range with respect to the applied voltage, and a control portion where a color image signal is inputted therein and a display signal is outputted to the display panel. The control portion includes a signal generator for generating and outputting a brightness display signal in the brightness change range, a hue display signal in the hue change range, and a signal for indicating a mixing ratio between the brightness display signal and the hue display signal, from the inputted color image signal. The display panel effects display, on the basis of the signal for indicating the mixing ratio, at a plurality of pixels in which pixels displaying in the brightness change range and pixels displaying in the hue change range are mixed.

7 Claims, 18 Drawing Sheets

U.S. PATENT DOCUMENTS

| | | | | |
|---|---|---|---|---|
| 7,154,458 | B2 * | 12/2006 | Nakanishi | 345/84 |
| 7,199,776 | B2 * | 4/2007 | Ikeda et al. | 345/89 |
| 2002/0008713 | A1 * | 1/2002 | Toji et al. | 345/694 |
| 2002/0105505 | A1 * | 8/2002 | Sendai | 345/204 |
| 2005/0036047 | A1 * | 2/2005 | Kohashi et al. | 348/272 |
| 2005/0110740 | A1 * | 5/2005 | Linzmeier et al. | 345/102 |
| 2006/0038825 | A1 * | 2/2006 | Sakashita | 345/592 |

FOREIGN PATENT DOCUMENTS

| | | |
|---|---|---|
| JP | 4-52625 | 2/1992 |
| JP | 7-334127 | 12/1995 |
| JP | 9-113868 | 5/1997 |
| JP | 9-127479 | 5/1997 |
| JP | 9-311309 | 12/1997 |
| JP | 11-202804 | 7/1999 |
| JP | 2004-258616 | 9/2004 |
| WO | WO 2004-042687 | 5/2004 |

OTHER PUBLICATIONS

Y. Asao, "New Color Display Method of LCD Realizing High Brightness and High Definition", Chemistry & Chemical Industry, vol. 56, No. 6, pp. 692-694 (Jun. 2005).

* cited by examiner

DISPLAY APPARATUS AND IMAGE FORMING APPARATUS

TECHNICAL FIELD

The present invention relates to a color display apparatus for effecting multi-color display.

BACKGROUND ART

There are currently a large number of color display technologies, which are widely used in a printing technique such as a printer or the like, a display device, etc. These color display technologies are roughly classified into:

1. a method wherein gradation is reproduced through pseudo-halftone representation such as dithering by means a device capable of displaying a discontinuous gradation color, and
2. a method wherein halftone is reproduced by means of a device capable of displaying a substantially continuous gradation color.

With respect to 2, it is possible to effect full-color display with no problem. For example, in a liquid crystal device using color filters of three colors of RGB, the respective display colors have analog gradation performance, so that it is possible to effect complete full-color display by spatial additive color mixture principle. Further, in a time-division color liquid crystal display method, light sources for three colors of RGB are switched at high speed and in synchronism therewith, a display device is subjected to among gradation control at high speed, so that it is possible to effect complete full-color display by timewise additive color mixture principle.

Even in the case where the display device itself has no gradation displayability, it has also been known that a substantially continuous gradation color can be displayed by effecting display at high speed through an ON/OFF operation. For example, plasma display panel (PDP) which has been widely popularized as a flat television, an organic EL display of the type wherein gradation display is effected by time division, a digital mirror device (DMD) which controls a display state by switching a mirror surface formed on a semiconductor substrate at high speed, and a method similarly using a ferroelectric liquid crystal (FLC), and the like are applicable.

As the color display technology other than the displays, there has been known a multi-value continuous gradation recording method using a density gradation method such as a laser intensity modulation in a laser-writing type printer or the like.

On the other hand, with respect to 1, it is put into practical use in the printer technology such as ink jet or laser beam, a bistable-type FLC display device, and the like. In these, a minimum display unit itself only has a discontinuous gradation displayability but pseudo-halftone display is effected by combining a plurality of display units and using the spatial additive color mixture effect.

This method includes one wherein the display medium itself can be controlled continuously but discontinuous gradation display is effected due to constraints of a control circuit. For example, a liquid crystal display device for effecting pseudo-full color display by using inexpensive driver ICs for 4 bit gradation in combination with dithering has been put into practical use.

Further, in the above described PDP, a phenomenon which is called pseudo-contour is visually recognized at the time of displaying motion picture in some cases. However, there is also a technique for obviating it by the spatial additive color mixture effect such as dithering. This is such a technique as to remedy a phenomenon that discontinuous gradation display is effected due to a visible factor at the time of displaying motion picture even in the case where a substantially continuous display is effected with respect to a still picture (image). In other words, there is also such a case where the above described case of 2 is applied to the still picture and the above described case of 1 is applied to the motion picture.

As described above, there are various display devices and color display is widely popularized but all the existent display methods are classified into the above described two methods. More specifically, the classified methods are only two methods consisting of a method of reproducing full-color display as it is by means of a device having an analog gradation displayability and a method of effecting pseudo-halftone display by using a device having a digital-like (discontinuous) gradation displayability in combination with a plurality of unit pixels and using the spatial additive color mixture effect.

On the other hand, e.g., in display of an interference color by an electrically controlled birefringence (ECB) effect in liquid crystal, in the case where an optical path difference in small, it is possible to effect continuous brightness modulation, and in the case where the optical path difference is larger than a predetermined value, the method is such a color display method that hue is changed while substantially retaining a brightness. In this case, only two display states of ON and OFF are present. More specifically, the method can be said to be a display mode in which analog gradation display and digital gradation display are co-present in a single pixel. This can be said to be a particular display method which is not applicable to any of the above described two methods.

As a method of providing multiple colors by using the color display based on the ECB (effect), a method wherein a plurality of pixels placed in different display states are combined has been disclosed in Japanese Patent No. 03098112. In this patent, a point that a unit pixel capable of effecting ECB color display is divided into two or more portions in an ECB-based color display device and different voltages are applied to the two or more portions to effect multi-color display has been disclosed.

Color display using the ECB effect has been little put into practical use. This is because a gradation displayability is inferior to those of other display methods. Although a proposal has been made by the above described patent document with respect to such a method that the unit pixel is divided and the respective ECB colors are combined to provide multiple colors, a gradation display method capable of providing a higher definition intermediary color has been required.

DISCLOSURE OF THE INVENTION

The present invention is a display apparatus, comprising:

a display panel comprising a plurality of pixels exhibiting a brightness change range with respect to an applied voltage and a hue change range with respect to the applied voltage, and a control portion where a color image signal is inputted therein and a display signal is outputted to the display panel, wherein the control portion comprises signal generation means for generating and outputting a brightness display signal in the brightness change range, a hue display signal in the hue change range, and a signal for indicating a mixing ratio between the brightness display signal and the hue display signal, from the inputted color image signal, and wherein the display panel effects display, on the basis of the signal for indicating the mixing ratio, at a plurality of pixels in which pixels displaying in the brightness change range and pixels displaying in the hue change range are mixed.

Further, the present invention is an image forming apparatus, comprising:

signal generation means for generating and outputting a brightness display signal in the brightness change range, a hue display signal in the hue change range, and a signal for indicating a mixing ratio between the brightness display signal and the hue display signal, from the inputted color image signal, and means for forming a color image, on the basis of the signal for indicating the mixing ratio, by a plurality of pixels in which pixels displaying in the brightness change range and pixels displaying in the hue change range are mixed.

These and other objects, features and advantages of the present invention will become more apparent upon a consideration of the following description of the preferred embodiments of the present invention taken in conjunction with the accompanying drawings.

BEST MODE FOR CARRYING OUT THE INVENTION

Hereinbelow, embodiments for carrying out the present invention will be described with reference to the drawings.

Basic Embodiment

The present invention is applicable to various embodiments as a display device but first of all, a display principle thereof will be explained with reference to FIG. 2 by using a liquid crystal having an ECB effect as an example.

As a color liquid crystal display apparatus without using a color filter, an electrically controlled birefringence (ECB)-type liquid crystal display apparatus has been known. The ECB-type liquid crystal display apparatus is constituted by a liquid crystal cell including a pair of substrates and liquid crystal sandwiched between the substrates, and in the case of that of a transmission-type, a polarization plate is disposed on a front surface and a back surface of the liquid crystal cell, and in the case of that of the reflection-type, there are one-polarization plate type display device in which only one of the substrates is provided with a polarization plate and two-polarization plate type display device in which both of the substrates are provided with a polarization plate and a reflection plate is disposed outside the polarization plate.

In the case of the ECB-type liquid crystal display apparatus of the transmission-type, linearly polarized light which comes in through one of the polarization plates is changed into elliptically polarized light consisting of respective wavelength light fluxes different in state of polarization by the action of birefringence of liquid crystal layer in a process of transmitting a liquid crystal cell. The elliptically polarized light enters the other polarization plate and the transmitted light having passed through the other polarization plate is colored light consisting of light fluxes of colors corresponding to light intensities of the respective wavelength light fluxes.

The ECB-type liquid crystal display device is capable of coloring light by utilizing the birefringence action of the liquid crystal layer of the liquid crystal cell and the polarization action of polarization plate, so that it causes no light absorption by the color filter, thus effecting bright color display at a high transmittance of light. In addition, the birefringence of the liquid crystal layer is changed depending on a voltage applied to the liquid crystal cell, so that by controlling the voltage applied to the liquid crystal cell, it is possible to change the color of the transmitted light or the reflected light. By utilizing this, it is possible to display a plurality of colors at one (the same) pixel.

Figure 1:
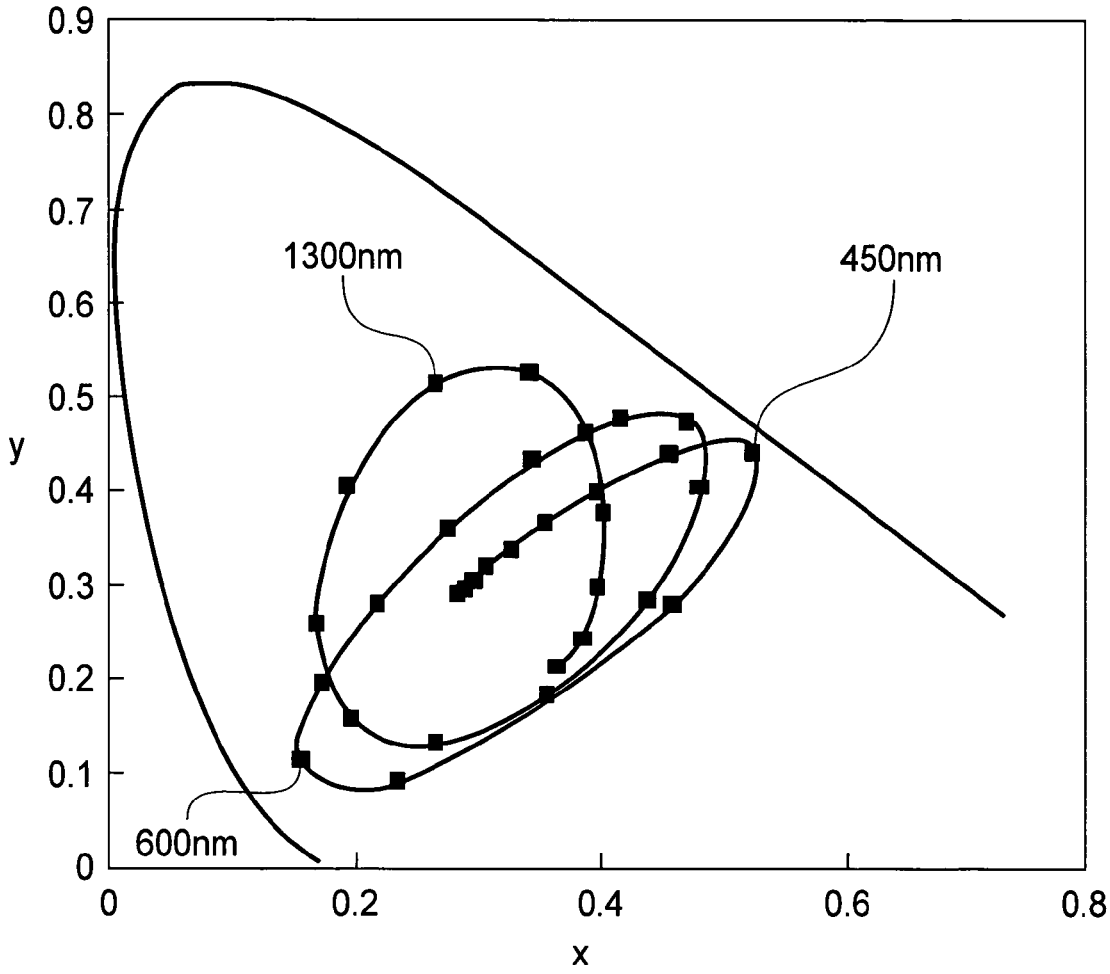
FIG. 1 is a diagram showing a change on a chromaticity diagram when an amount of retardation is changed.

FIG. 1 shows a relationship between an amount of birefringence (called retardation R) of the ECB-type liquid crystal display device and coordinates on a chromaticity diagram. It is found that the color at a retardation R from 0 to about 250 nm is achromatic color since the retardation range is located substantially at a center portion of the chromaticity diagram but is changed when the retardation exceeds the retardation range.

When a liquid crystal material having a dielectric anisotropy (represented by $\Delta\epsilon$) which is negative is used as the liquid crystal and liquid crystal molecules thereof are homeotropically (vertically) aligned with respect to the substrates, the liquid crystal molecules are inclined with voltage, so that an amount of birefringence (called a retardation) is increased with a degree of the inclination of the liquid crystal molecules.

In this case, in a cross-nicol condition, the chromaticity is changed along a curve indicated in FIG. 1. When the voltage is not applied, R is substantially zero, so that light does not pass through the display device to provide a dark (black) state. With an increase in voltage, brightness is increased in the order of black, gray, and white. When the voltage is further increased, the light is colored to change the color in the order of yellow, red, magenta, blue, cyan, light green, . . . , and green.

As described above, under voltage application, the ECB-type display device is capable of changing the brightness between a maximum brightness and a minimum brightness in a modulation range on a low voltage side under and changing a plurality of hues in a high voltage range.

A basic principle of such an ECB-type display device has been well known from 1970s, and was put into practical use for specific multi-color display. However, there has not been known an image processing method suitable for the time of displaying natural picture (image).

The present invention provides a display apparatus using a display panel, such as the ECB-type liquid crystal display device, constituted by including pixels exhibiting a brightness change range with respect to an applied voltage and a hue change range with respect to the applied voltage.

The display apparatus of the present invention includes a signal generation means for, from an inputted color image signal generating and outputting a brightness display signal in the brightness change range, a hue display signal in the hue change range, and a signal for indicating a mixing ratio between the brightness display signal and the hue display signal.

Based on this mixing ratio-indicating signal, a pixel for effecting display in the brightness change range and a pixel for effecting display in the hue change range are co-present, so that gradation display is effected by a digital gradation method, such as dithering.

Hereinbelow, the present invention will be described by using a color solid.

Herein, the color solid can be considered that the three primary colors of RGB are represented as independent victors by making approximation to a cube and all the display colors are present in the cube in an additive color mixture system.

Figure 2:
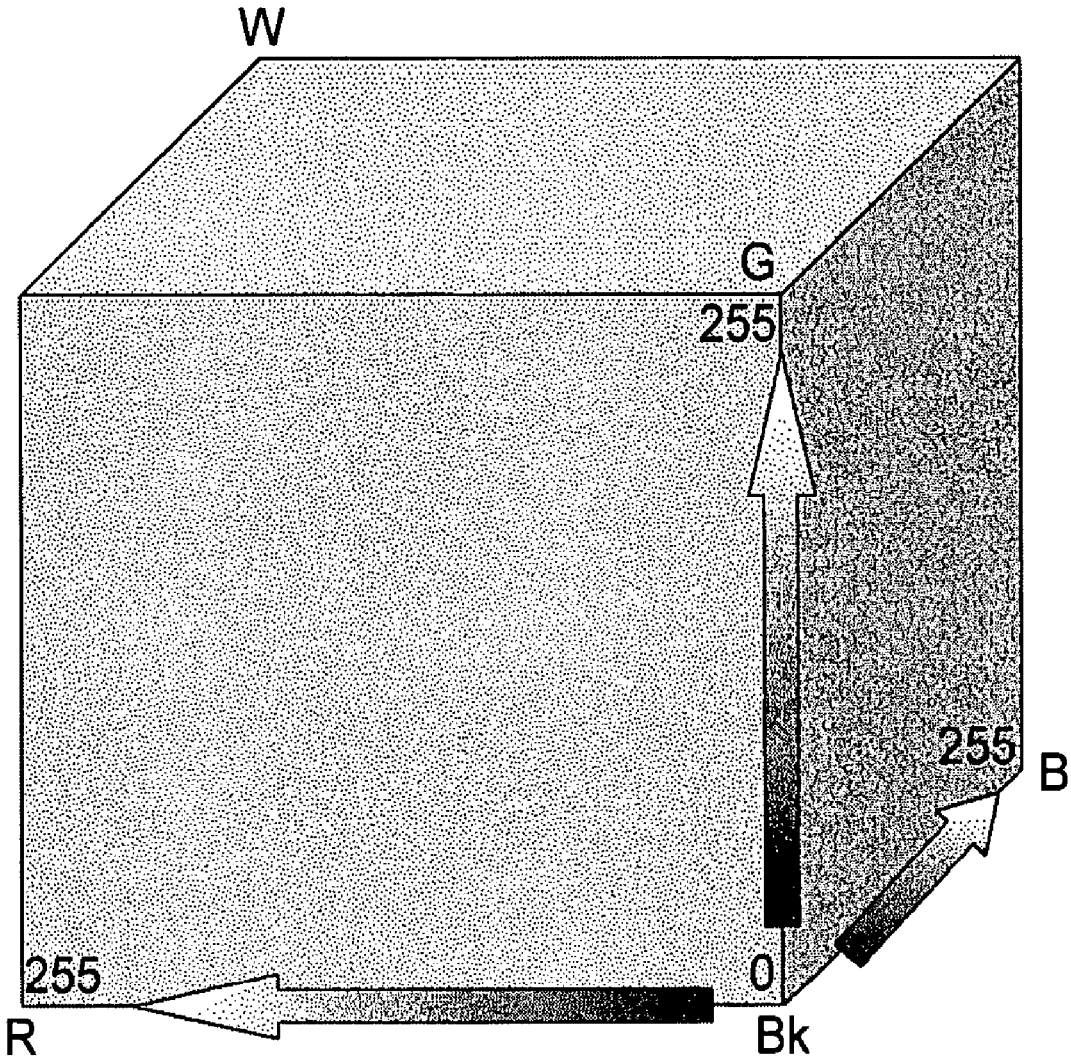
FIG. 2 is a view showing a color solid.

FIG. 2 shows the display colors which can be displayed in the RGB additive color mixture system, wherein an arbitrary point in the cube represents a color mixture state of R/G/B corresponding to a coordinate value thereof and a vertex indicated by Bk represents a minimum brightness state. Here, when an image information signal for R/G/B is supplied, a display color corresponding to a position of the product of the R/G/B independent vectors extended from the Bk point is displayed.

In the figure, R, G and B represent maximum brightness states of red, green and blue, respectively, and W is a white display state at a maximum brightness. Incidentally, a length of one edge is 255.

Here, for example, in a general liquid crystal display device having color filters of three colors of RGB, the respective colors can be controlled independently in a continuous gradation manner. This means that in the color solid, a magnitude of each of three independent vectors constituting the color solid can be independently controlled at an arbitrary value from zero to a maximum. As a result, it is possible to freely control all the points in the color solid, so that the respective magnitudes of the RGB independent vectors are determined uniquely with respect to any input image signals. For this reason, it is possible to freely effect full-color output.

Figure 3:
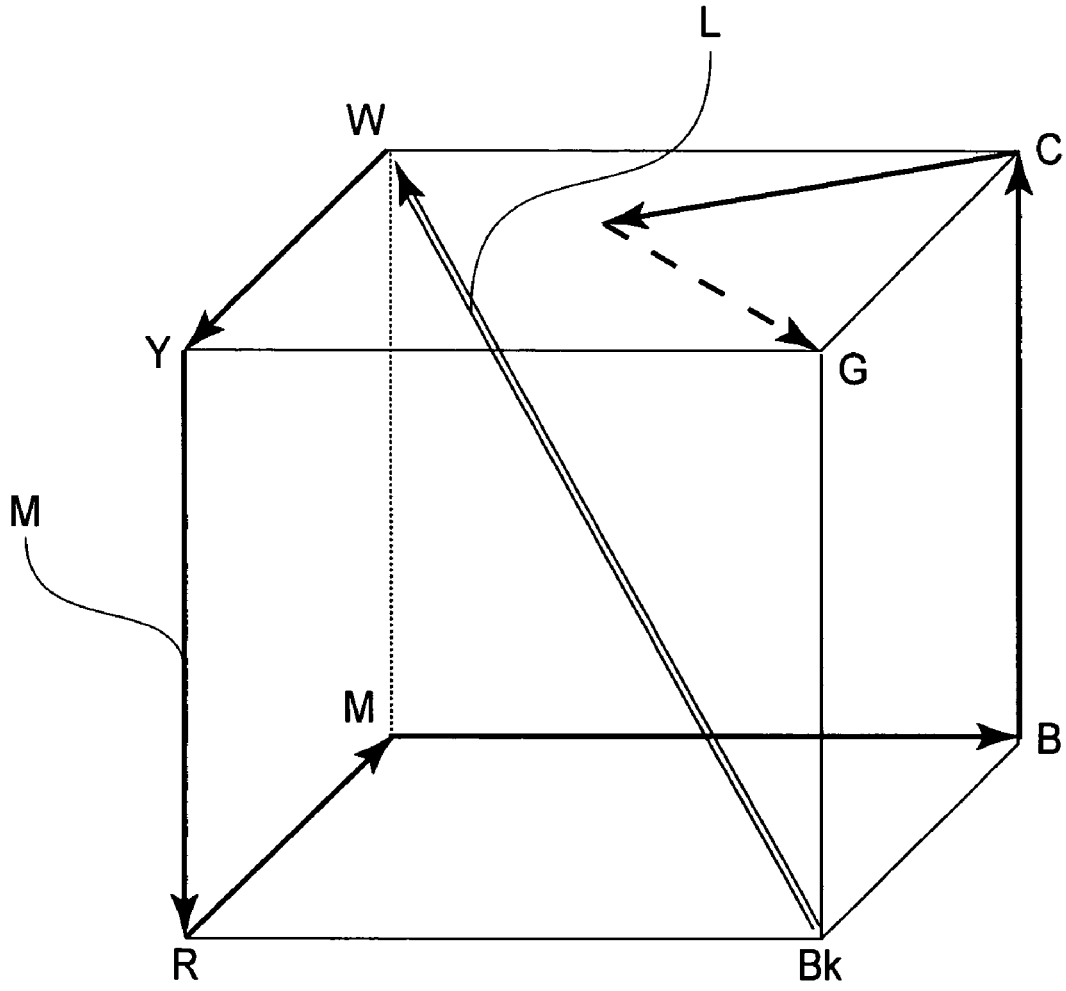
FIG. 3 is a view showing loci in the color solid.

By using this color solid, loci of display colors available to the above described ECB-type display device are shown in FIG. 3. In this figure, a straight line L connecting black, white, and their intermediate colors and a locus M shown by a continuously changing chromatic color in the color solid are shown. These L and M are a connected one curved line but are herein indicated separately in order to differentiate between a brightness change of a chromatic color and a hue change of chromatic color. Thus, only the points on the lines in the color slid can be represented in the ECB-type display device, so that it is difficult to effect natural picture display if nothing is done. Accordingly, it becomes necessary to use an image processing, for displaying intermediary colors by the spatial color mixture effect using a plurality of pixels, such as dithering, error diffusion method, or the like.

On the other hand, as described above, the method wherein a plurality of unit pixels are combined by a device having a digital like (discontinuous) gradation displayability and the spatial color mixture principle is used to effect pseudo-halftone display has been widely put into practical use. However, there is no method, including analog gradation, of effecting the pseudo-halftone display, so that it is necessary to newly device the method.

Incidentally, in the dithering or the error diffusion method described above, a plurality of different pieces of discrete output information have to be selected in order to represent an arbitrary analog signal by the spatial color mixture effect using the plurality of pixels. In the conventional image processing method, any of the plurality of the pieces of discrete output information had to be selected from pieces of the discontinuous digital gradation information. For example, in an ordinary two-valued dithering, either one of bright and dark is selected and in a multi-valued dithering, when an inputted analog gradation information is an intermediary value between i-th gradation level and (i+1)-th gradation level, either one of discrete gradation information of the i-th gradation level and the (i+1)-th gradation level is selected.

On the other hand, in the image processing method in the present invention, at least one output information of the plurality of pieces of discrete output information is selected from pieces of continuous (analog) gradation information, so that a natural picture (image) reproducibility is improved even compared with the conventional multi-valued dithering.

A specific method of this will be described below were specifically.

First Embodiment

Figure 4:
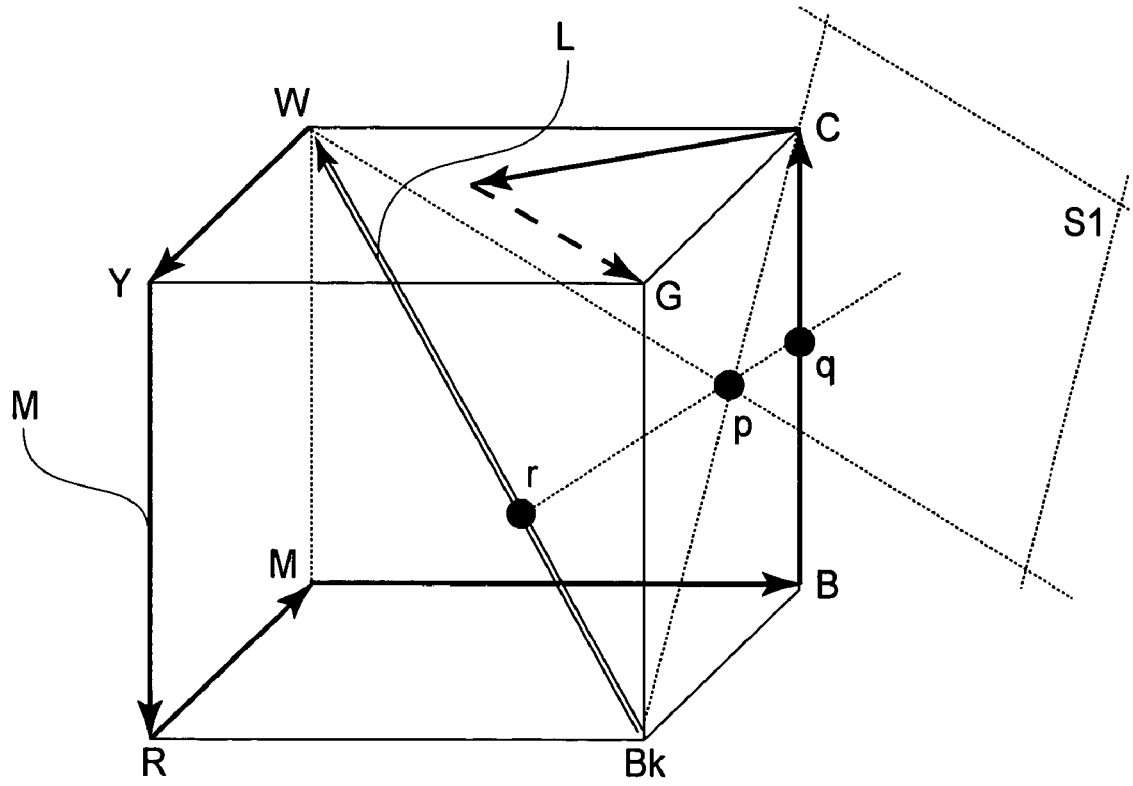
FIG. 4 is an explanatory view of First Embodiment of the present invention.

When an arbitrary analog input image signal is given, a point at which RGB data thereof are independent vectors, respectively, is taken as p. This is shown in FIG. 4.

In the ECB-type display device, white, black and their intermediary colors are controlled by substantially continuous brightness change to be displayable. This brightness change area is indicated by a straight line L in FIG. 4 and it is possible to display any point on the straight line L. A plane comprising these p and L in the color solid is virtually determined, and the plane is taken as S1.

On the other hand, as described above, in the ECB-type display device, there is such a modulation area that a hue is changed in a high retardation area. This is indicated in the color solid of FIG. 3 as a curve M. In the case where a point of intersection of this curved line M and the above described plane S1 can be determined, the intersection point is taken as q. This q is one of the pieces of discrete digital output information used in the above described image processing.

Next, an intersection point of a straight line comprising q and p and the above described straight line L connecting white and black is taken as r. This r is remaining one of the pieces of discrete digital output information.

The point p is located on a straight line connecting q and r. When p is an internally dividing point of q and r and an internally dividing ratio is taken as m:n, p is represented by:

$$p=(mr+nq)/(m+n).$$

There is also a possibility that p is an externally dividing point of q and r but in such a case, there is another intersection point of the plane S1 and the curve m. For this reason, such another intersection point is selected so that q and r are selected so as to take p as an intersection point. When p is located in the color solid and moved to an area determined by the curved line M, specifically when point Q on the curved line M is moved from W to G, if p is located inside an area through which a triangle created by Q, Bk and W passes, it is always possible to select q and r so that p is their intersection point.

As described above, q and r are an image information pair in place of p. By using two display values of q and r instead of p, it is possible to display a halftone corresponding to p in a similar method to the dithering in the ordinary two-valued display. Details of the dithering will be described later.

The present invention is intended to reproduce intermediary colors according to the spatial color mixture by selecting discrete values such as q and r from continuous information p of the color solid and appropriately selecting either one of the values q and r over a plurality of pixels while making reference to a certain threshold matrix.

Second Embodiment

In the case where a pixel is divided into a plurality of subpixels, a plurality of L and M described above can be drawn. A similar concept is also applicable to this case and will be described with reference to FIGS. 5 to 8.

Figure 5:
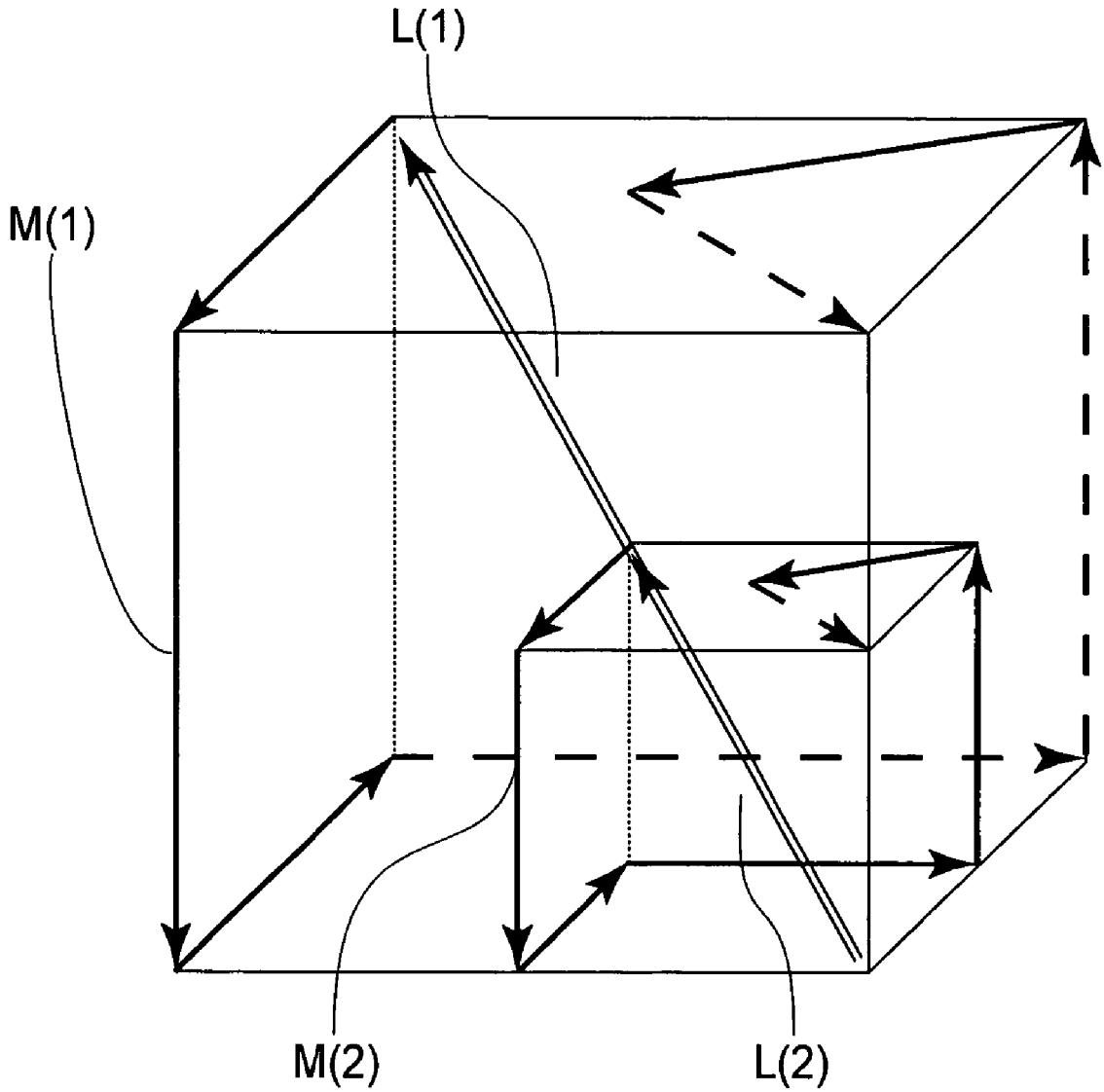
FIG. 5 is an explanatory view of Second Embodiment of the present invention.
Figure 6:
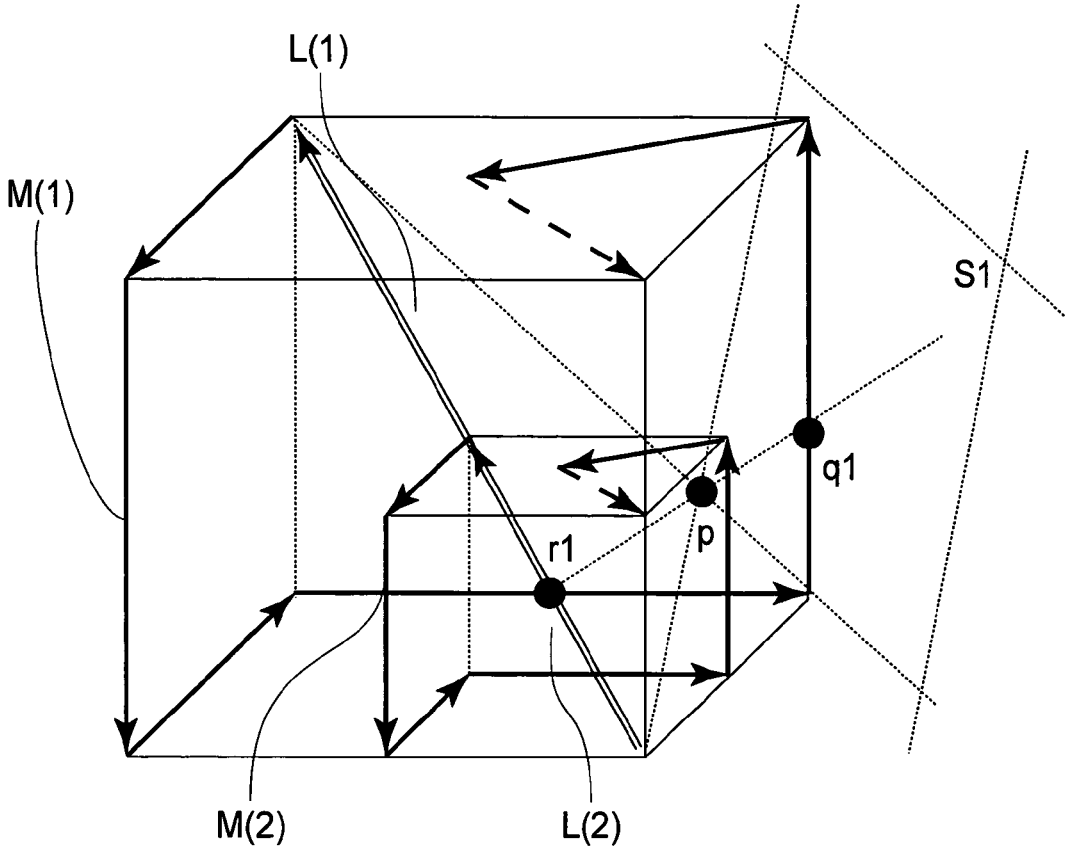
FIG. 6 is an explanatory view of Second Embodiment of the present invention.

FIG. 5 shows an example of display colors available to an RGB color solid in the case where one pixel is divided into two subpixels having the same area. In this figure, a straight line L(1) and a curved line M(1) represent available lines when the two subpixels are driven under the same condition, and a straight line L(2) and a curved line M(2) represent available line X when only either one of the two subpixels is driven. In actual fact, the subpixels can be driven independently, so that it is possible to draw the same-shaped line X from an arbitrary point on the straight line L(2) or the curved line M(2). Herein, for simplicity's sake, by using only L(1), M(1), L(2) and M(2), explanation will be made in FIG. 6.

Similarly as in the case of FIG. 4, a plane of an input signal p and the straight line L(1) is determined and an intersection point q1 of the plane and any one of the plurality of curved lines M is determined. Herein, first, the case of the curved line M(1) is considered. After an intersection line r1 of a straight line pq1 and the straight line L(1) is determined, intermediary color display on the basis of the spatial color mixture effect may be effected by using display information of r1 and q1.

Figure 7:
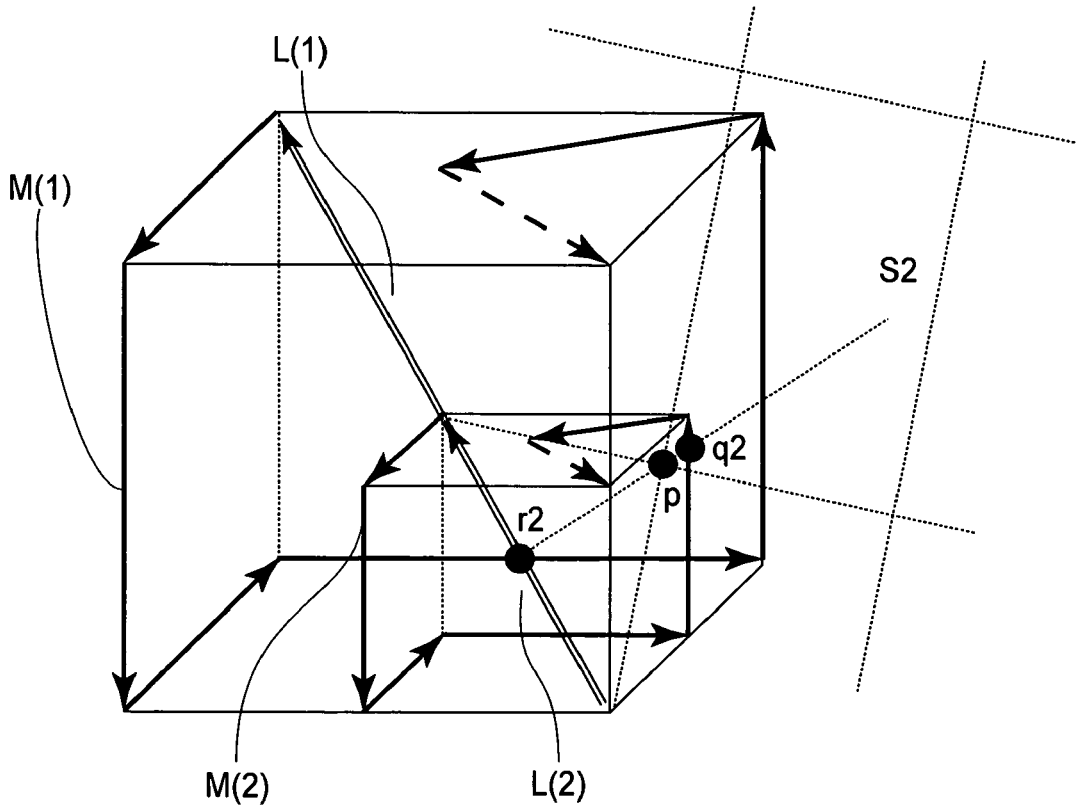
FIG. 7 is an explanatory view of Second Embodiment of the present invention.

The case of using the curved line M(2) will be described with reference to FIG. 7. When the same input image signal p is given, a plane S2 of the input signal p with the straight line L(2) is determined and an intersection point q2 of the input signal p and the curved line M(2) is determined. After an intersection point r2 of a straight line pq2 and the straight line L(2) is determined, intermediary color display on the basis of the spatial color mixture effect may be effected by using display information of q2 and r2.

Figure 8:
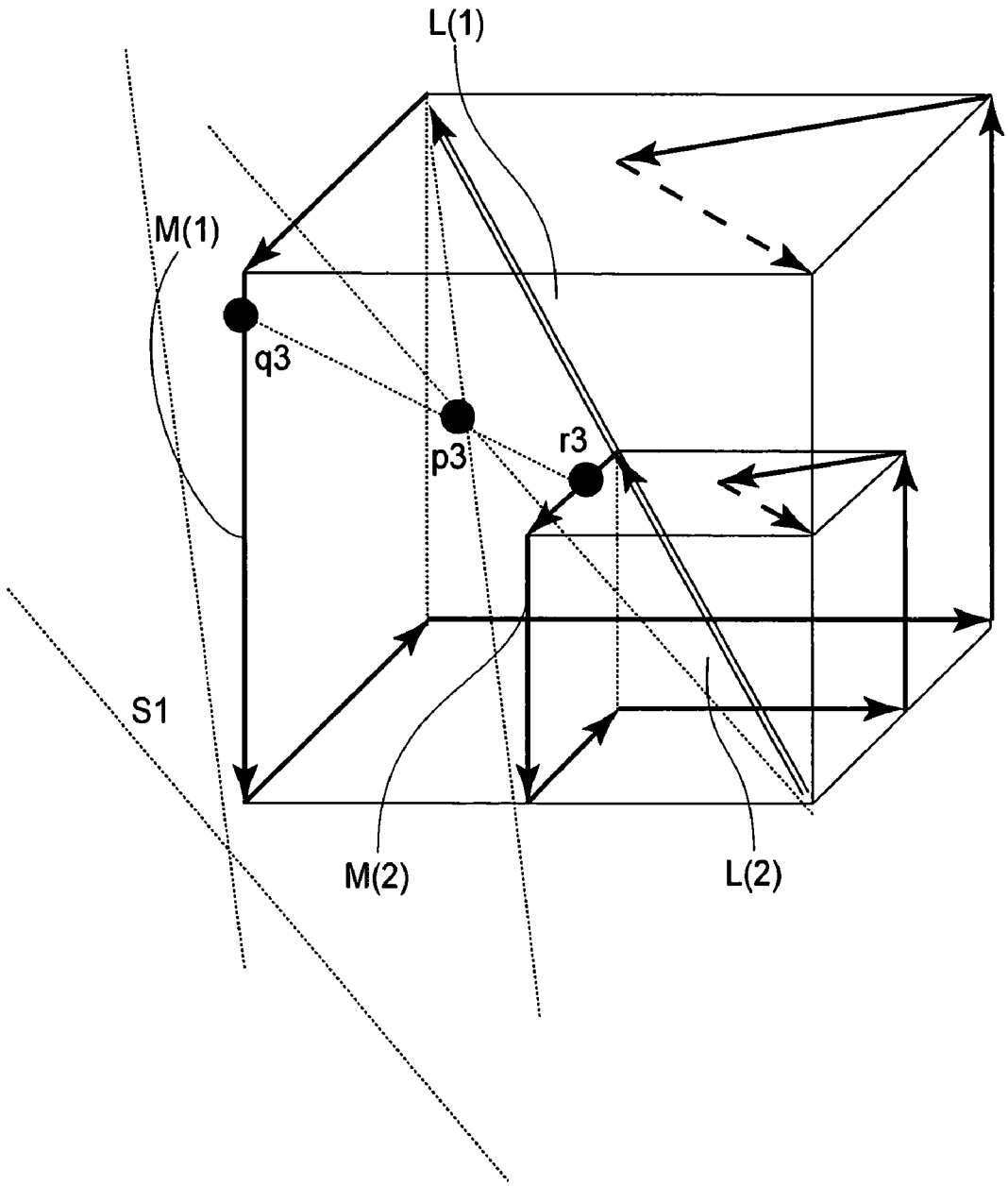
FIG. 8 is an explanatory view of Second Embodiment of the present invention.

Further, in this case, when there is an intersection point of the straight line pq with another M, not the straight line pq with the straight line L, intermediary color display on the basis of the spatial color mixture effect may also be effected by using the intersection point. For example, as shown in FIG. 8, with respect to an input signal p3, by using display information of q3 and r3, spatial color mixture effect-based intermediary color display may also be effected.

Figure 9:
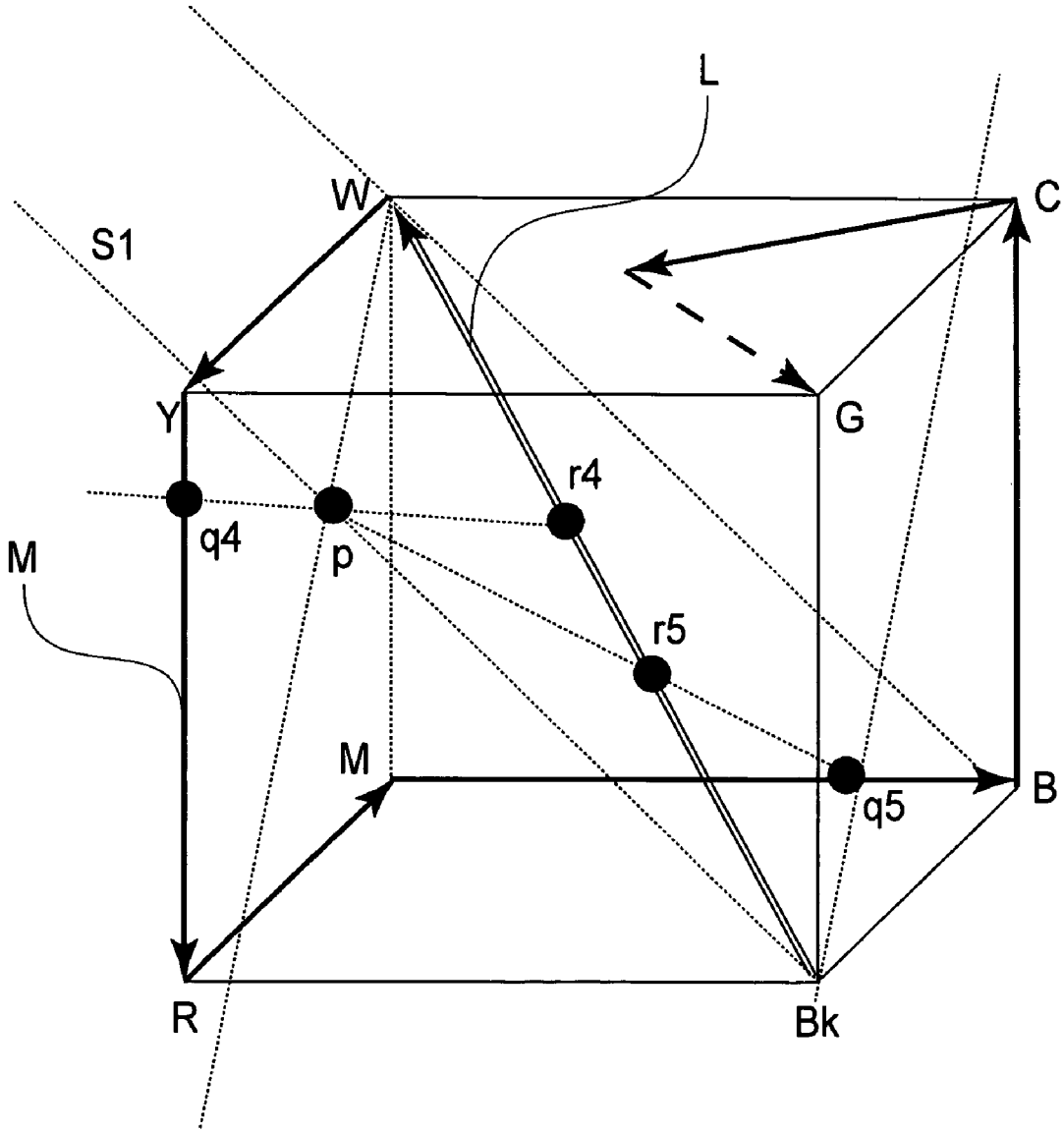
FIG. 9 is an explanatory view of First Embodiment of the present invention.

In either case, as described above, a reproduction ability by the spatial color mixture effect at the time of the intermediary color display is remarkably enhanced by selecting discrete values used therein from continuous information. Incidentally, there is also a possibility of presence of the above described point q as a plurality of points. In this case, the point q has to be selected so that a line obtained by extending a line segment pq to the p side intersects with the straight line L in the range from Bk to W of the straight line L. For example, in the case of FIG. 9, the plane S1 intersects with the curved line M at two points q4 and q5 but q5 and r5 obtained therefrom cannot make approximation of p as an input signal since p does not internally divide q4 and q5. Accordingly, in this case, q4 and r4 obtained therefrom have to be used. Further, in the case where a plurality of points q are present and each point q provides an extrapolated line of the straight line pq intersect the straight line L in the range between Bk and W to determine point r, any of the point p may be used.

On the other hand, there is a case where it is not possible to determine the point q depending on the input signal. In such a case, it is inevitable that an accurate display color cannot be reproduced, so that it becomes possible to effect display close to the input signal by making approximation at the closest point.

With respect to FIG. 4, explanation will be made by using specific mathematical formulas.

The straight line L from the point Bk to the point W in the RGB color solid can be represented by R=G=B. On the other hand, it is hypothesized that a coordinate of the input signal located in the RGB color solid is ($P_R$, $P_G$, $P_B$) and the above described plane S1 is a R+bG+cB+d=0. The plane S1 passes through an origin, so that d=0. Further, from the relationship: R=G=B, a+b+c=0 holds. The plane S1 is a plane passing through ($P_R$, $P_G$, $P_B$), so that when these are subjected to substitution and arrangement, a normal vector of the plane S1 is uniquely defined as (($P_B$−$P_G$), ($P_B$−$P_R$), ($P_R$+$P_G$−2$P_B$)). An intersection point q (qR, qG, qB) of the plane S1 and the curved line M can be readily obtained if a function represented by the curved line M is determined. A straight line passing through two points consisting of the points q and p is represented by:

$$\frac{R-q_R}{p_R-q_R}=\frac{G-q_G}{p_G-q_G}=\frac{B-q_B}{p_B-q_B}$$

An intersection point (rR, rG, rB) of this straight line and the straight line L being R=G=B can be represented by:

$$\left(\frac{q_R p_G - q_B p_R}{q_R - q_G - p_R + p_G}, \frac{q_R p_G - q_B p_R}{q_R - q_G - p_R + p_G}, \frac{q_R p_G - q_B p_R}{q_R - q_G - p_R + p_G}\right)$$

These points q and r are output information. By using these, dithering or the like may be performed.

(Dithering)

Next, dithering will be described in detail. As an example thereof, Bayer-type ordered dither method using a 4×4 matrix will be described.

The point p is taken as an internal division point of q and r. A line segment connecting q and r is divided into 16 portions and an internal division point closest to p is determined. When an internal division ratio at the point is m:n, p is represented by $$p=\frac{nq+mr}{m+n}.$$

The point p is represented as respective RGB components by the following equations:

$$p_R=\frac{nq_R+mr_R}{m+n}$$
$$p_G=\frac{nq_G+mr_G}{m+n}$$
$$p_B=\frac{nq_B+mr_B}{m+n}$$

In the equations, m and n are an integer and satisfy:

$$m+n=16.$$

Figure 10:
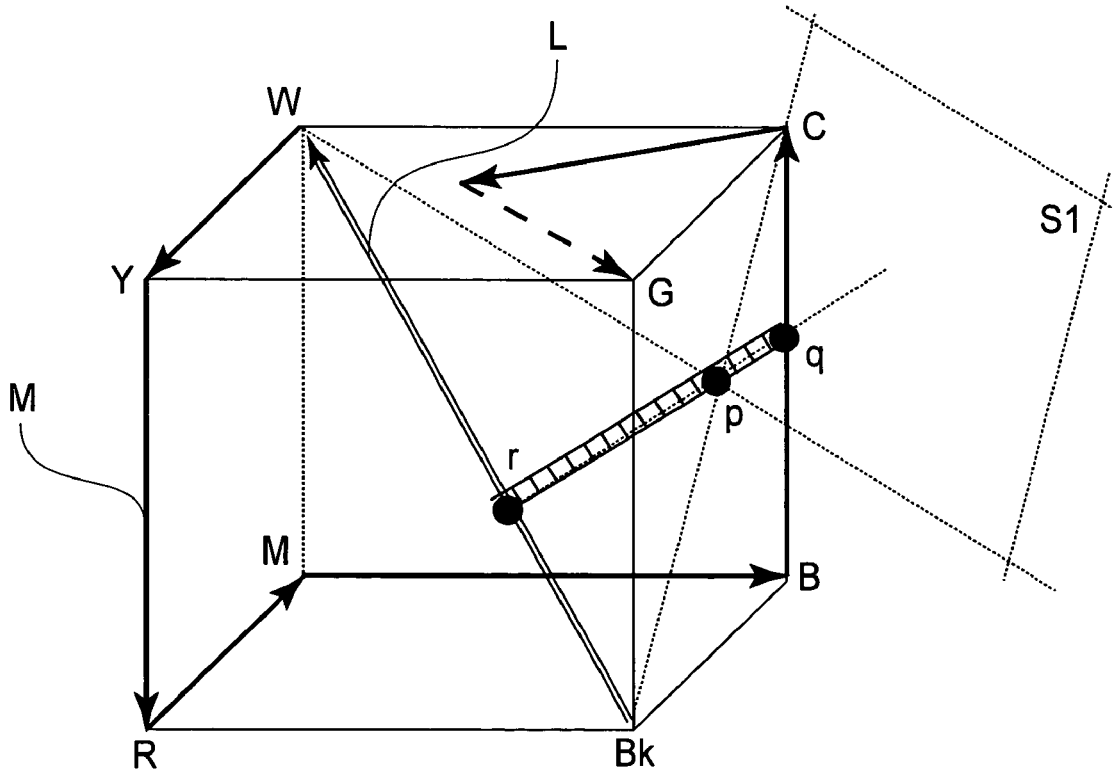
FIG. 10 is an explanatory view of signal formation in First Embodiment of the present invention.

This procedure is shown in FIG. 10. The line segment qr is divided into 16 portions and p is close to the portion which is fourth from q and twelfth from r. In this case, m=4 and n=12 are determined.

In the dither method, a halftone level given with respect to one area including a plurality of pixels (a pixel block of 4×4=16 in this embodiment) is represented according to two-valued display (by discrete gradation display of three or more values in some cases) at each pixel in the area. With respect to the pixels in the area, the order thereof is determined in advance, so that all the pixels are placed in one state (block) at level 0 and the pixels are replaced with white in that order with an increasing gradation level. In this case, depending on m or n determined as described above, determination may be made as to whether the point q should be selected or the point r should be selected. For example, when m=4 and n=12, 12 pixels are placed in a state of q (chromatic display) and 4 pixels are placed in a state of r (achromatic display).

Figure 11:
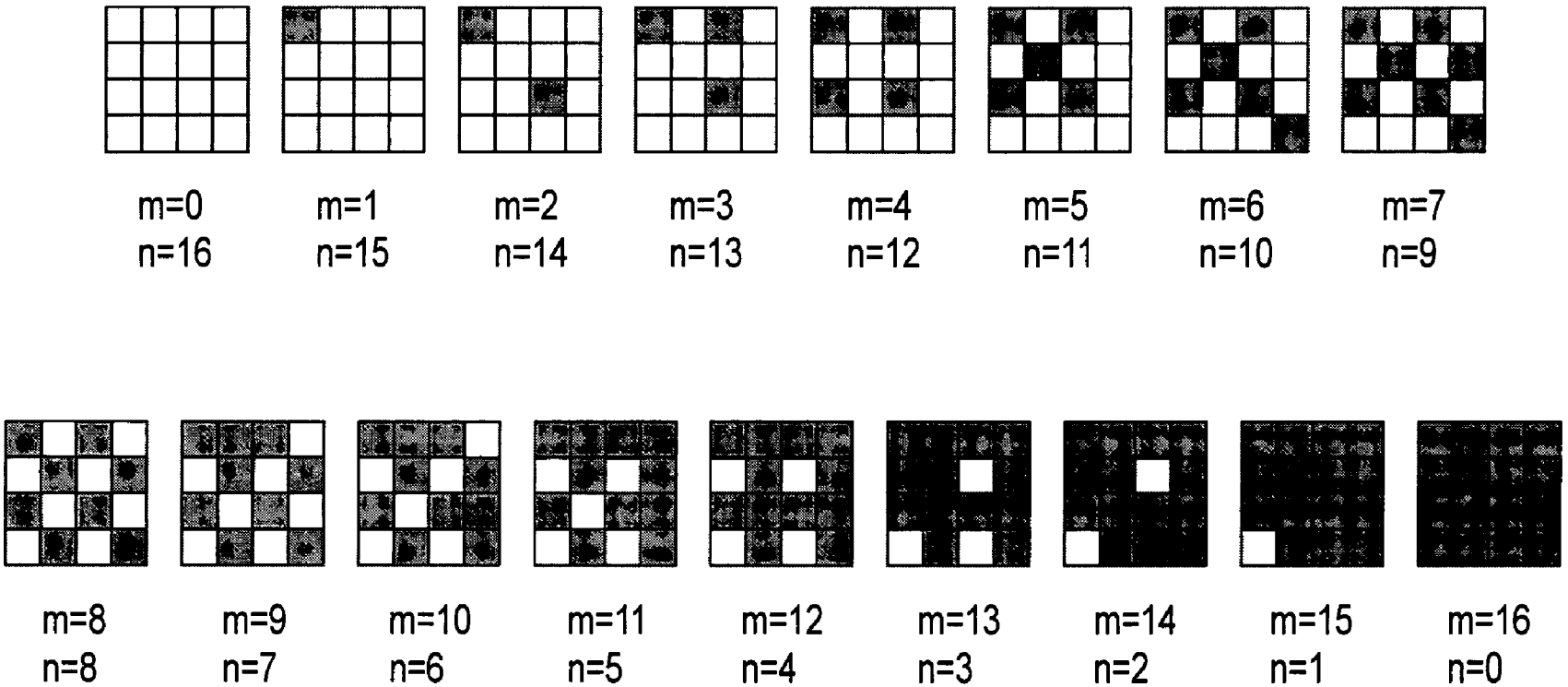
FIG. 11 is an example of gradation display in the present invention.

With respect to how to assign the two values, Bayer-type dither matrix of:

$$\begin{pmatrix} 1 & 9 & 3 & 11 \\ 13 & 5 & 15 & 7 \\ 4 & 12 & 2 & 10 \\ 16 & 8 & 14 & 6 \end{pmatrix}$$

or the like is utilized. By comparing threshold information of respective pixels in the block with a value of m or n, if m is smaller than the threshold value, i.e., n is not smaller than the threshold value, q is displayed at the pixel. If not so, r is displayed at the pixel. FIG. 11 shows block display with respect to 17 possible values of m and n. In the figure, a white pixel represents a chromatic display state and a (dark) gray pixel represents an achromatic display state.

When a degree of gradation is high, the block is made large to provide 16×16 pixels at 256 gradation levels but in that case, determination of m and n is made similarly as in the above described case. Incidentally, herein, the dither method is described but an error diffusion method or the like is similarly applicable.

Applied Embodiments

The number of displayable colors is remarkably increased by combining interference display by the ECB-type display device with a color filter. This will be described below more specifically.

Figure 13:
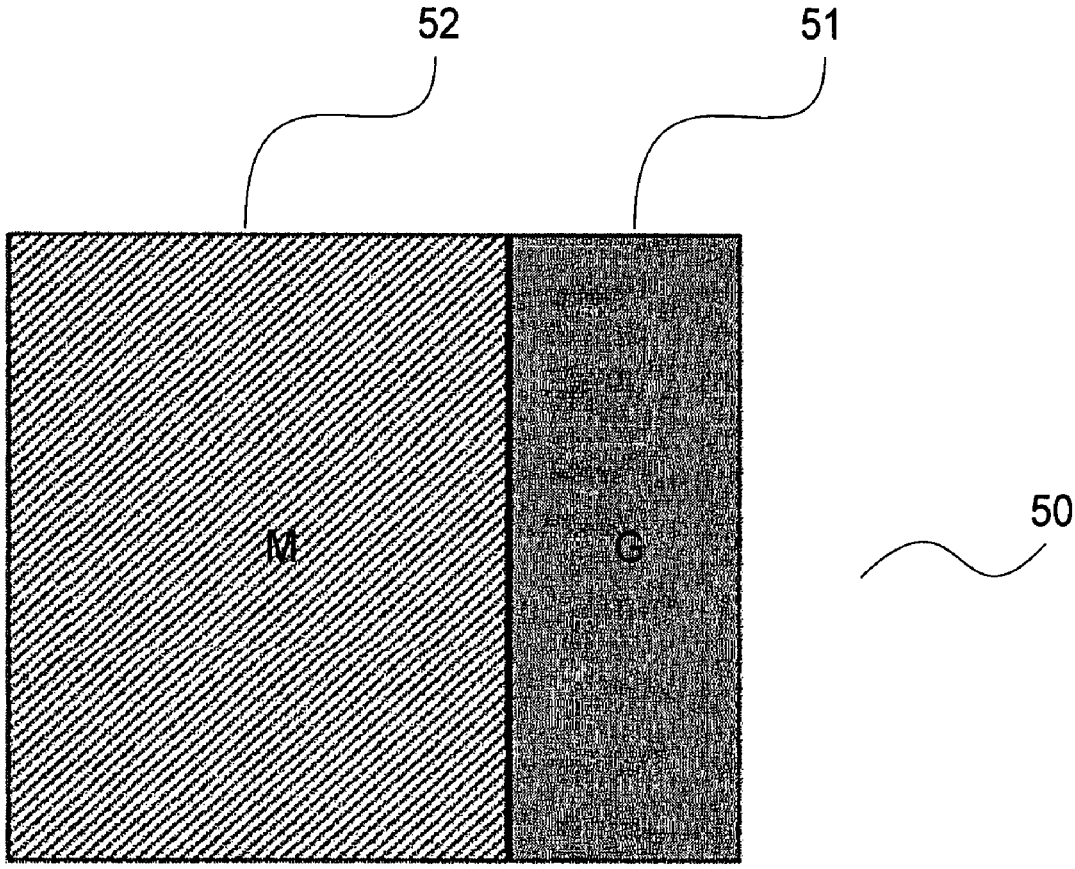
FIG. 13 is a view showing a pixel constitution of the liquid crystal display device used in the present invention.

In a liquid crystal display device used in the present invention, as shown in FIG. 13, one pixel 50 is divided into a plurality of subpixels 51 and 52 of which one subpixel 51 is provided with a color filter of any one of RGB. The remaining subpixel 52 is provided with a color filter of a color complementary to the color of the color filter used for the subpixel 51.

The liquid crystal layer assumes a change in brightness of an achromatic color from black to white and a change in hue of chromatic color from e.g., red to various colors such as blue through magenta. However, the color filter is superposed on any of the subpixels 51 and 52, so that the color to be displayed is a change obtained by a retardation of the liquid crystal layer and a display color obtained by a subtractive color mixture principle.

Hereinbelow, as an example thereof, the case where a green color filter is used as the color filter for the subpixel 51 and a magenta color filter is used as the color filter for the subpixel 52 is considered. In this case, at the subpixel 51, the green color filter is provided and green of the color filter is displayed by changing the retardation in a brightness change range under voltage application, so that it is possible to cause an independently continuous brightness change in green display. On the other hand, the magenta color filter is provided at the subpixel 52, magenta of the color filter is displayed by changing the retardation in a brightness change range under voltage application, so that it is possible to cause a independently continuous brightness change in magenta display.

In addition thereto, in the ECB-type display device, red display and blue display can be effected in a hue change area in the high retardation area, so that red display and blue display can also be effected similarly at the time of the subtractive color mixture display with magenta. If anything, by the effect of magenta, such an effect that a color reproduction range of red display and blue display on the chromaticity diagram is enlarged can be expected.

The ECB-type display device in this embodiment exhibits the range in which a brightness is changed continuously with respect to the applied voltage but in the hue change range, some of discrete values are selected from those of continuous change in hue and used for display.

From the inputted color image signal, a continuous gradation display signal in the brightness change range and a discontinuous discrete hue display signal in the hue change range are generated.

Figure 14:
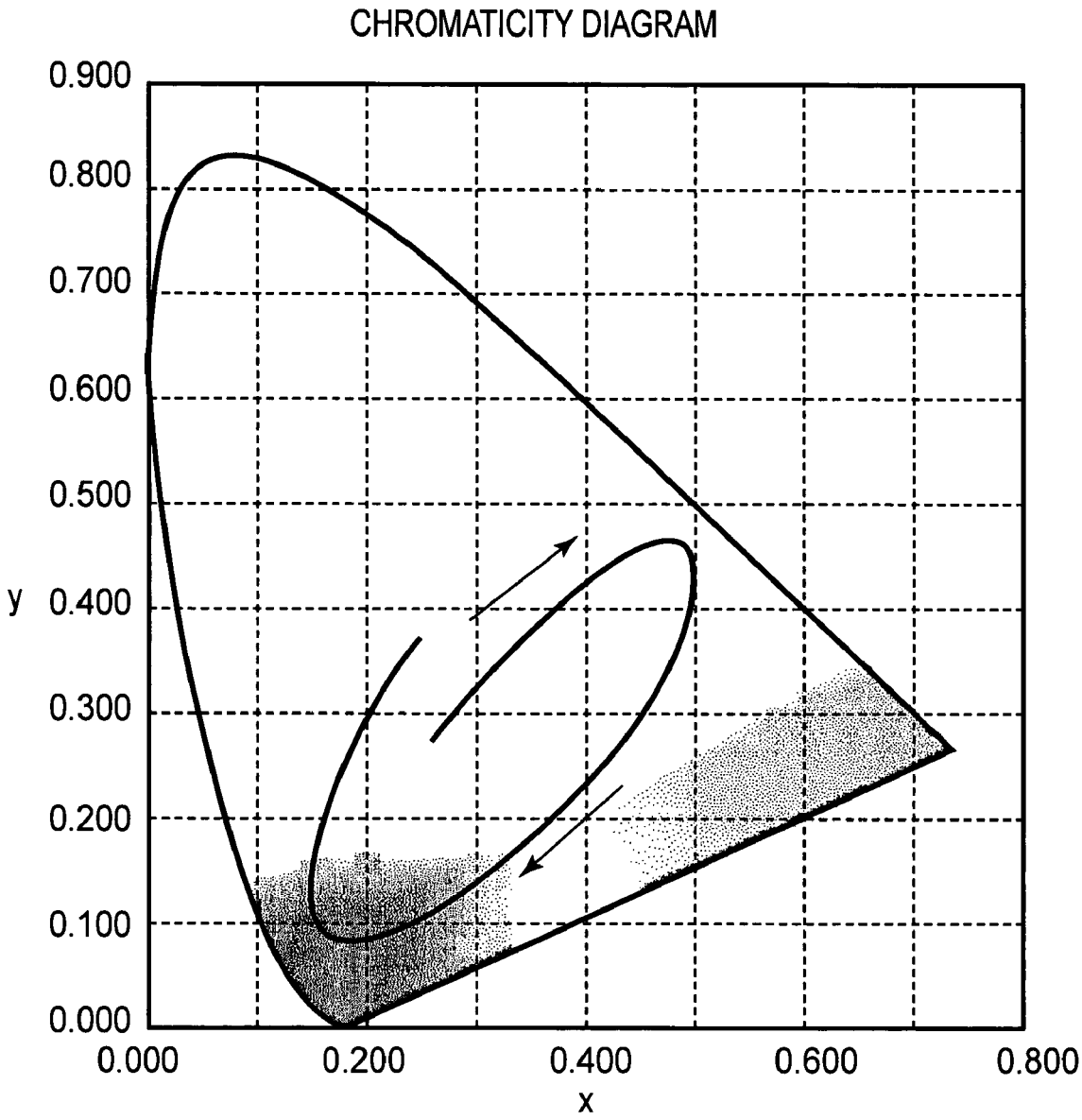
FIG. 14 is a diagram showing a change on a chromaticity diagram when an amount of retardation is changed in the liquid crystal display device in the present invention.
Figure 15:
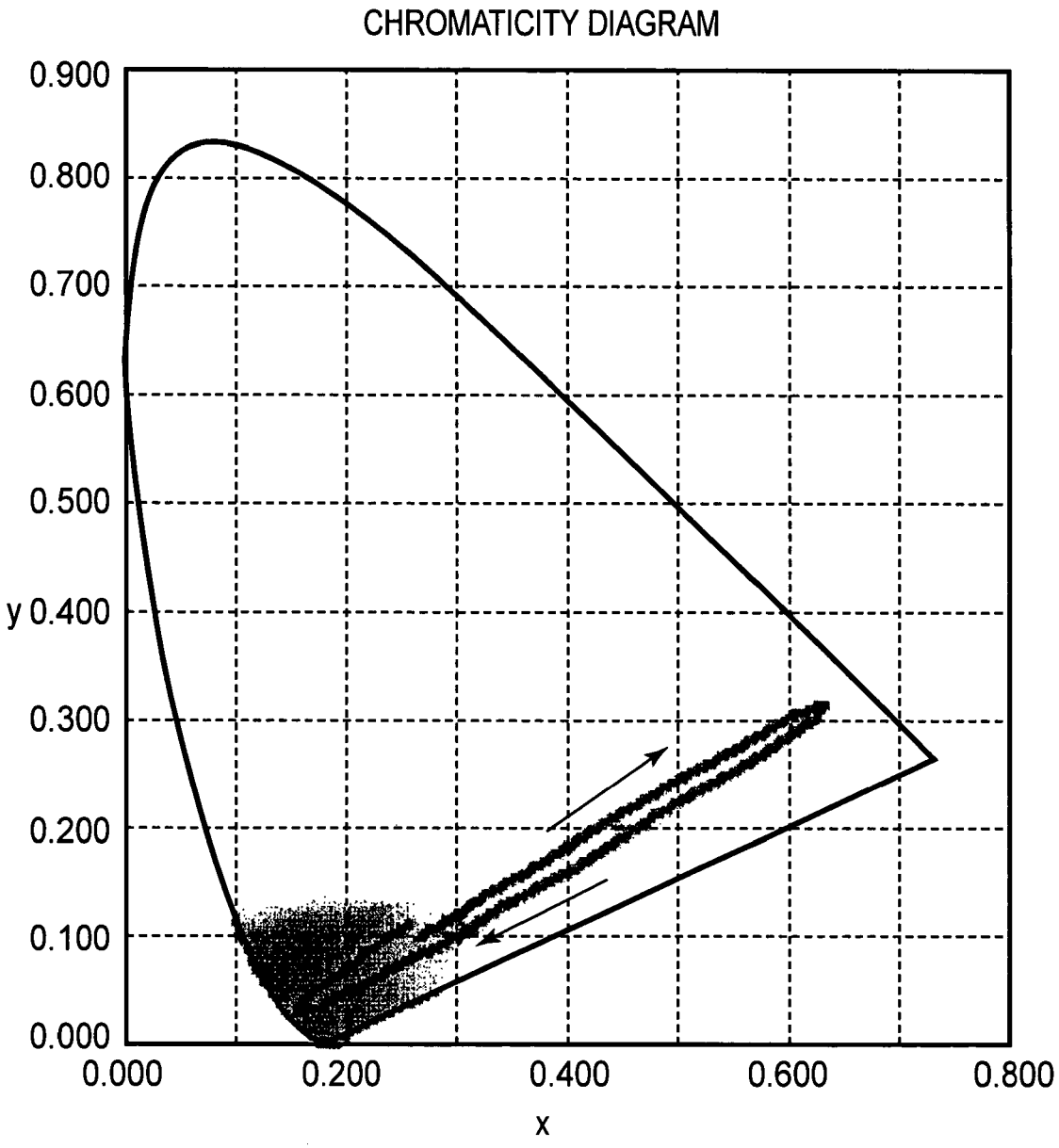
FIG. 15 is a diagram showing a change on a chromaticity diagram when an amount of retardation is changed in the case where a color filter of a color complementary to green is provided in the liquid crystal display device in the present invention.

The pixel may be provided with a color filter. In this case, the pixel exhibits the range in which a brightness of the color of the color filter is continuously changed with respect to the applied voltage and the range in which a hue is discontinuously changed with respect to the applied voltage. FIG. 14 shows a state of a hue change with no magenta color filter and FIG. 15 shows a state of a hue change when an ideal color filter which blocks all the light from 480 nm to 580 nm and permits 100%-transmission of other lights is used. As described above, it is found that the color reproduction range of red display and blue display on the chromaticity diagram is enlarged.

Next, a bias display principle in this embodiment will be described briefly.

For example, it is possible to display white as the entire pixels by placing a green (G) pixel provided with a green color filter and a pixel (M) provided with a magenta color filter in their maximum brightness states.

In order to provide a single color of G, the G pixel is placed in a maximum transmission state and the M pixel is placed in a dark state. In order to provide a single color of R (B), the G pixel is placed in a dark state and a retardation value at the M pixel is set to 450 nm (600 nm). By combining these, it is also possible to obtain mixed colors of R and G, and B and G.

It is needless to say that black display is effected when the retardation at both of the G pixel and the M pixel is set to 0 to place the pixels in their dark states.

In a constitution of the liquid crystal display device used in the present invention, the retardation is changed in the range from 0 to 250 nm at the G pixel and is changed at the magenta pixel in the range from 0 to 250 nm and in the range from 450 nm to 600 nm. Ordinarily, the liquid crystal material is common to the subpixels, so that a drive voltage range is set to be different between the subpixels.

In this embodiment, the example of the liquid crystal device is shown but, it is also applicable to those other than the liquid crystal device by effecting display with the color filter at the G pixel and effecting display of other primary colors by colors generated by medium (liquid crystal in the above case) itself as described above. More specifically, generally, the present invention is applicable when a medium which changes an optical property by externally applied modulation means and the medium exhibits a brightness change modulation area and a hue change modulation area, by the modulation means. With respect to display colors on the color solid when the above described display device is used, description is made more specifically hereinbelow.

In the above described color solid, in an applied embodiment described herein, it is possible to effect continuous gradation display with the use of the color filter with respect to green, so that it is possible to take arbitrary points independently in the green direction. Accordingly, when a discussion about the display color is made hereinafter, the discussion is had on a plane constituted by red and blue vectors (hereinbelow referred to as an RB plane).

First, the case of a single pixel utilizing an ECB effect-based coloring phenomenon (the case of no pixel division) will be described with reference to FIG. 16.

Figure 16:
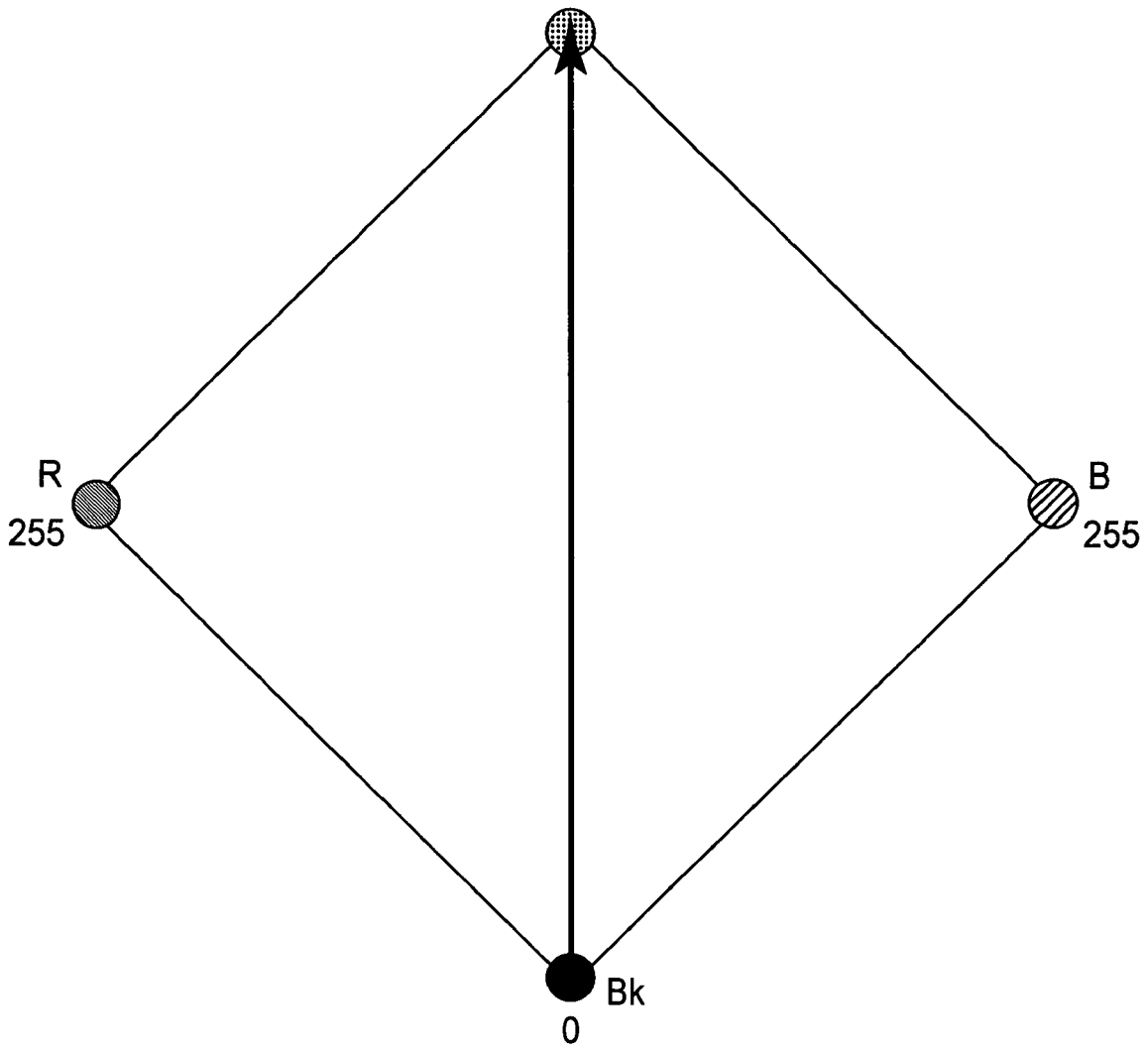
FIG. 16 is a view for explaining display colors which can be displayed on a red/blue plane in the liquid crystal display device in the present invention.

FIG. 16 shown an RB plane. Here, at the times of red display and blue display, the ECB effect-based coloring phenomenon is utilized, so that available values as bright and dark display states are two values of ON and OFF. Therefore, available points on the respective axes of R and B are two points of a maximum value (R, B) and a minimum value (Bk).

On the other hand, in the case where the magenta color filter of the color complementary to green is provided, it is possible to change a brightness of magenta by changing the retardation at the magenta pixel in the range of 0-250 nm. The display colors in this range are located on an axis in a combined vector of R and B indicated by an arrow in FIG. 8 on the RB plane, thus corresponding to a continuous brightness change. More specifically, in FIG. 16, the points Bk (origin), R, B and an arbitrary point on the arrow can be used as the display color.

In this case, the pixel is constituted by a first subpixel provided with a magenta color filter and a second subpixel provided with a color filter of a color complementary to the color of the magenta color filter.

At the first subpixel, a brightness of the color of the color filter is continuously changed and a discrete value of blue and red is provided in the hue change range. On the other hand, at the second pixel, the display color is a single color of green, so that it is sufficient to modulate the display color in the brightness change range of the color filter with respect to the applied voltage.

A signal generation circuit outputs a brightness display signal, a hue display signal for any one of blue and red, and a signal indicating a mixing ratio therebetween to the first subpixel and outputs a green brightness display signal to the second subpixel.

Image processing when an arbitrary input image signal is given in this case will be described.

In this embodiment described, it is possible to independently provide a continuous value with respect to green, so that it is possible to represent analog gradation information without particularly performing image processing with respect to green. As described above, in the conventionally well-known image processing method such as two-valued dithering, multi-valued dithering, or the like, discontinuous gradation display is effected with respect to any display color. On the other hand, in the image processing in the present invention, with respect to a certain specific display color, a continuous brightness modulation is employed, so that it is not necessary to use halftone display by the spatial color mixture effect. By this, a gradation displayability is dramatically enhanced.

Next, an image processing method with respect to remaining red/blue display will be described. An orthogonal projection of input image information on the RB plane is taken as t.

In the RB plane, it is possible to cause a continuous brightness change in the magenta direction. More specifically, it is hypothesized that an available locus of a display color obtained by additive color mixture of two primary colors of R and B is taken as N, a point indicating an available display color of the two primary color is taken as v, and an intersection point of an extended line of a straight line, connecting the above described points v and t, with the locus N is taken as w. By using these selected points v and w, display of intermediary color is effected on the basis of the spatial color mixture effect, so that a halftone reproduction ability is dramatically enhanced. Particularly, in the case of this method, different from Basic Embodiment, there is no color space position which cannot be reproduced, so that it becomes possible to display an input analog signal with very good reproducibility.

Figure 17:
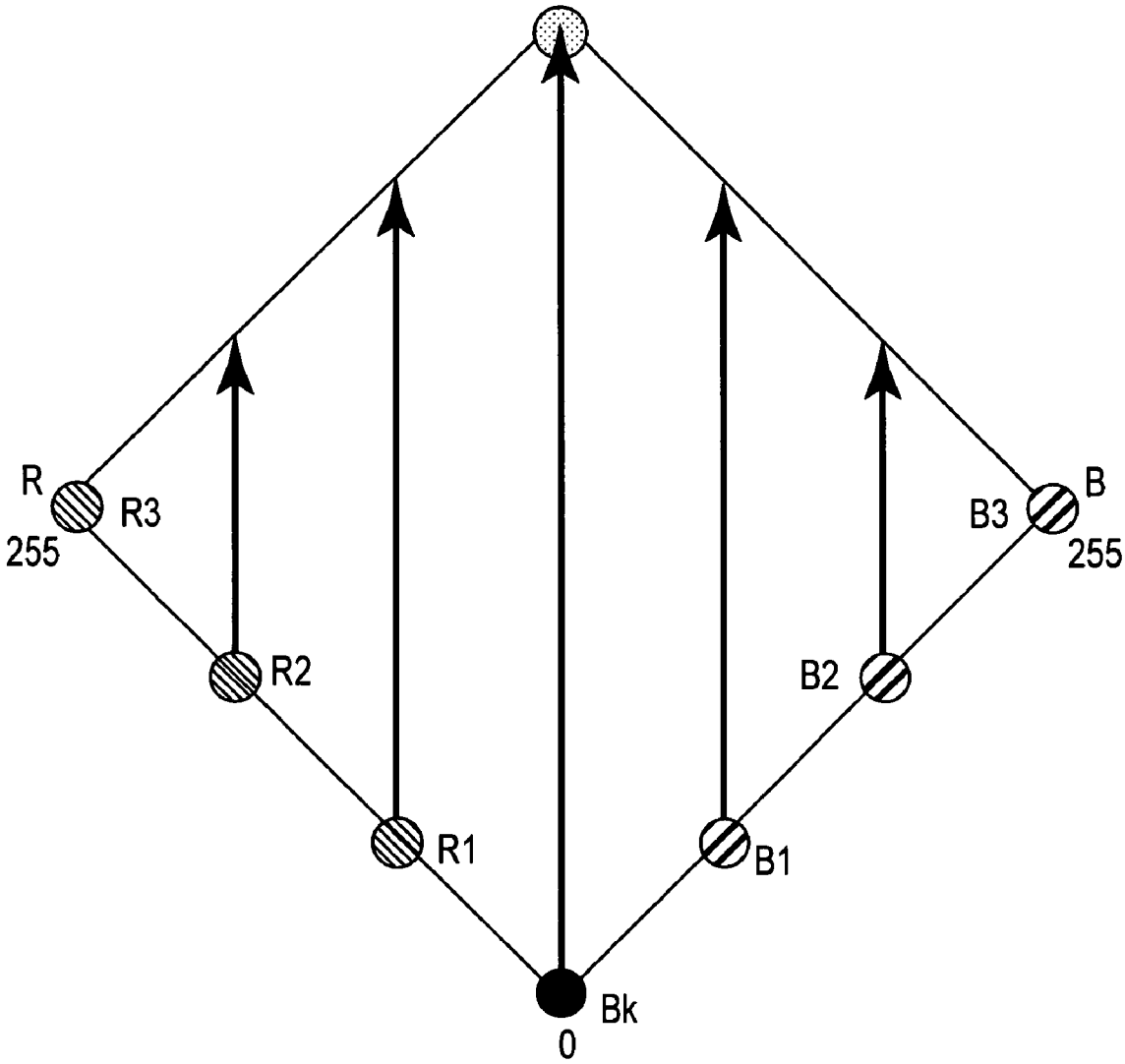
FIG. 17 is a view for explaining display colors which can be displayed on a red/blue plane in another constitution of the liquid crystal display device in the present invention.

In the case where the magenta pixel is, e.g., divided at an areal ratio of 1:2, a plurality of the above described loci N are present and at the same time, a plurality of the points v indicating the available display color of the two primary colors which caused discontinuous brightness change are also present. Incidentally, a state of the RB plane at this time is shown in FIG. 17.

Figure 18:
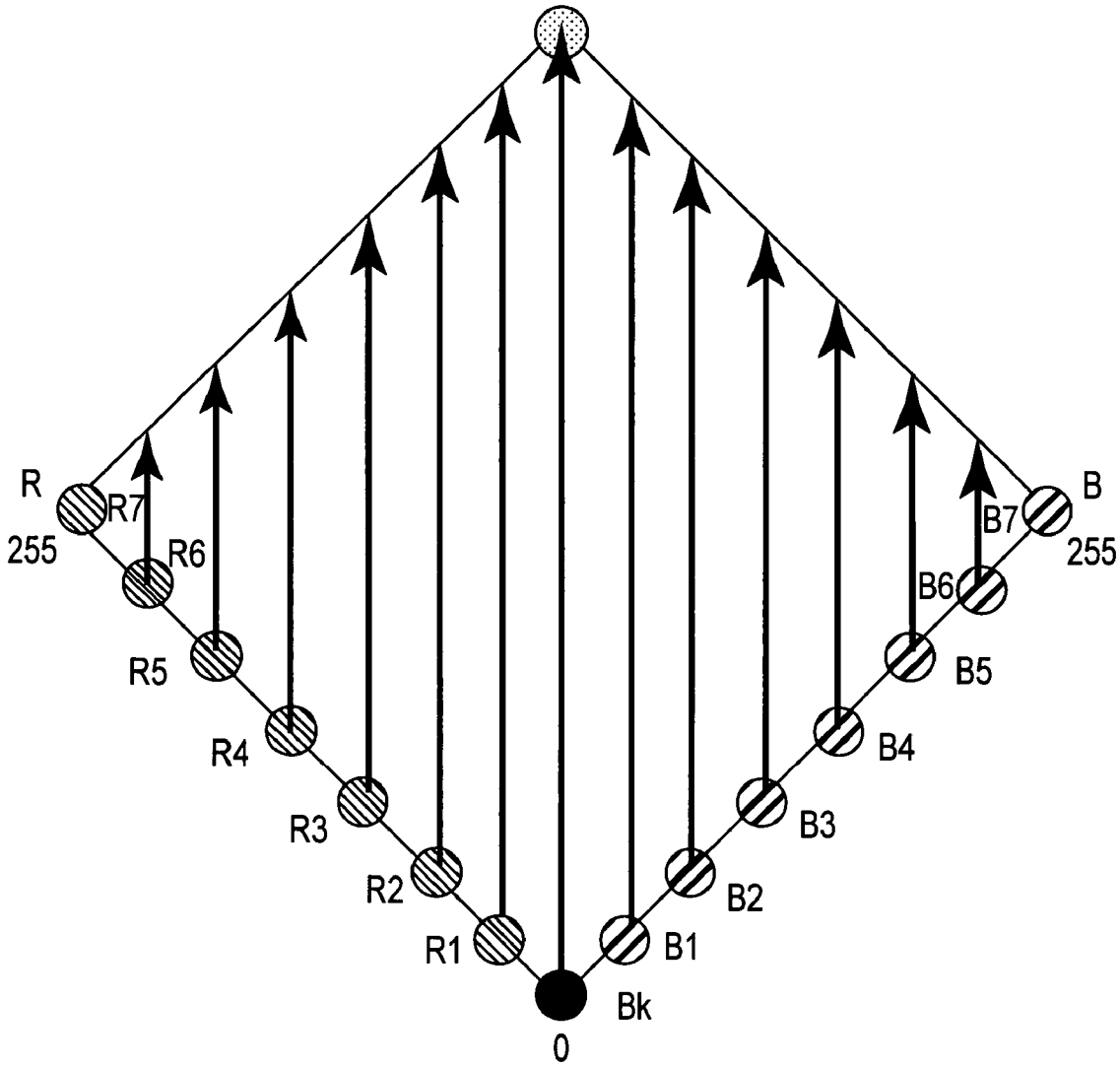
FIG. 18 is a view for explaining display colors which can be displayed on a blue/red plane in another constitution of the liquid crystal display device in the present invention.

The case of dividing the pixel at an areal ratio of 1:2:4 is shown in FIG. 18.

When these are Ni and vi, an intersection point of an extended line of a straight line, connecting any one of the points vi and the point t described above, with any one of the loci N is taken as w. By using any one of the points vi and the point w, display of intermediary color is effected on the basis of the spatial color mixture effect, so that a halftone reproduction ability is enhanced dramatically. Particularly, in the case of this method, different from Basic Embodiment, there is no color space range which cannot be reproduced, so that it becomes possible to display the input analog signal with very good reproducibility.

Incidentally, a method of applying the dithering is the same as the method described in Basic Embodiment. PS (Application to Devices Other than Liquid Crystal Display Device)

In the above description, detailed explanation is made principally based on the ECB effect of the liquid crystal. However, other than the above described constitution using the ECB effect, it becomes possible to apply any display device to the display apparatus of the present invention so long as the display device usable in the image processing in the present invention is a display device in which a display color capable of causing continuous brightness change and a display color causing discontinuous hue change are co-present.

As an example thereof, hereinbelow, explanation will be made with respect to:

(1) a mode in which a space distance of an interference layer is changed by mechanical modulation, and (2) a mode in which colored particles are moved so as to switch a display state and a non-display state.

More specifically, the mode (1) is, e.g., a constitution as described at page 71 of SID 97 Digest, wherein a distance of a spacing between the interference layer and a substrate is changed to switch display and non-display modes of interference color. In this mode, ON/OFF switching is performed by external voltage control of a deformable aluminum film so that the film comes near to or away from the substrate. Further, a color development principle in this mode is based on utilization of interference, so that the same discussion as the color development based on the ECB effect-based interference described above is held.

Accordingly, also in the above spacing distance modulation device, it is possible to change an optical property by an externally controllable modulation means, such as a voltage, so that the device has a modulation area in which a brightness can be changed by the modulation means between a maximum brightness and a minimum brightness which are available by the device and a modulation area in which a plurality of hues which are available by the modulation means. Accordingly, it becomes possible to apply the image processing method in the present invention.

In the mode (2), e.g., a particle movement-type display device described in Japanese Laid-Open Patent Application No. Hei 11-202804 are suitably utilized. In this embodiment, switching between a display state and a non-display state is performed by applying a voltage between a collection electrode and a display electrode to move in parallel with a substrate surface through utilization of an electrophoretic characteristic.

It is also possible to apply this switching so as to have a constitution using two types of color particles. More specifically, it is also possible to provide a unit cell constitution including: two display electrodes disposed at mutually overlapping positions when viewed from an observer's side; two collection electrodes; two types of charged particles which are different in charge polarity and color and include at least one type thereof being transparent; and a drive means capable of forming a state in which all the two types of charged particles are collected at the collection electrode, a state in which they are collected at the display electrode, a state in which one of the two types of charged particles are collected at the display electrode and the other type of charged particles are collected at the collection electrode, and an intermediary state of these states.

Such a constitution that the combination of the colors of the two types of charged particles in the unit cell is that of blue and red is considered. In this case, when white display is effected, it is sufficient to drive the display device so that all the two types of charged particles are collected at the collection electrode to place the display electrode in an exposed state. Further, in the case of displaying a single color of red or blue, in the unit cell, only desired single-color particles are disposed on the display electrode to display the single color. For example, in the case of blue display, the blue particles may be disposed on a display electrode to form a light-absorbing layer and the red particles may be collected on a collector electrode. On the other hand, in the case of displaying black, all the charged particles are disposed on the display electrode to form a light-absorbing layer, so that light enters each of the light-absorbing layers of red charged particles at a first display electrode and that of blue charged particles at a second display electrode, thus assuming black according to subtractive color mixture. In the case of halftone display, only a part of the particles at the time of displaying black are disposed on the display electrode. By doing so, in the unit cell, it is possible to effect modulation of hue between the chromatic colors of red and blue and modulation of brightness by display of white, black and halftone. It is possible to apply the present invention to even such a device.

The present invention provides the display apparatus and a method of forming a signal supplied thereto but it is clear that the signal forming method in the present invention is also applicable to image formation with a printer other than the display.

Hereinbelow, the present invention will be described more specifically based on Examples.

(Common Device Structure)

As a common device structure used in Examples, the following structure was used.

As a liquid crystal layer structure, a basic constitution was the same as the constitution shown in FIG. 3.

Two glass substrates subjected to vertical alignment treatment, were applied to each other to form a cell, and a liquid crystal material (Model: "MLC-6608", mfd. by Merck & Co., Inc.) having a dielectronic anisotropy ($\Delta\epsilon$) which was negative was injected as a liquid crystal material into the cell. Incidentally, at this time, a cell thickness was changed to provide an optimum retardation depending on Examples.

As the substrate structure used, one of the substrates was an active matrix substrate provided with thin film transistors (TFTs) and the other substrate was a substrate provided with color filters, as desired, depending on Examples. At this time, a shape of pixels and a color filter constitution were changed appropriately depending on Examples.

As a pixel electrode on the TFT side, an aluminum electrode is used to provide a reflection-type constitution.

Between an upper substrate (color filter substrate) and a polarization plate, a wide-band λ/4 plate (phase-compensation plate capable of substantially satisfying ¼ wavelength condition in visible light region) was disposed as a phase-compensation plate, thereby to provide such a constitution that a dark state was given at the time of no voltage application and a bright state was given at the time of voltage application when reflection-type display was effected.

REFERENCE EXAMPLE 1

For reference, an active matrix liquid crystal display panel having a diagonal length (size) of 12 inches and 600×800 pixels was used. A pixel pitch was about 300 μm. Each pixel was divided into three portions provided with color red, green and blue, respectively. A liquid crystal layer was adjusted to have a thickness of 2.3 μm so as to provide a center wavelength of 550 nm and an amount of a retardation of 138 nm for a reflection spectrum characteristic at the time of applying a voltage of ±5 V.

Figure 12:
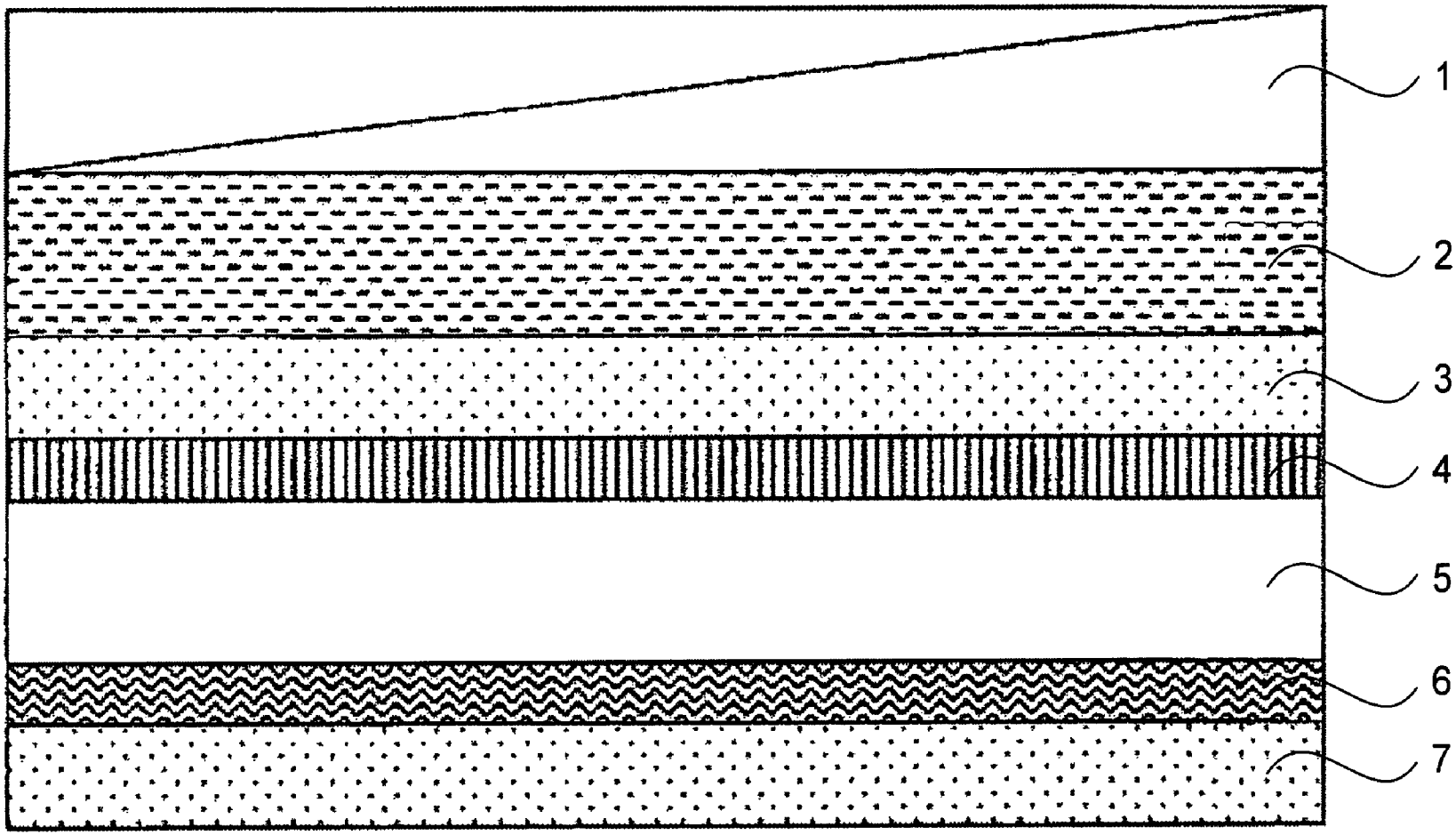
FIG. 12 is a sectional view of a liquid crystal display device used in the present invention.

A cell cross-section structure is shown in FIG. 12. A display device 100 is a lamination structure of a polarization plate 1, a phase difference plate 2, and a liquid crystal panel 90. In the liquid crystal panel 90, Examples 4 and 6 are formed on upper and lower two substrates 3 and 7 and a liquid crystal 5 is sandwiched therebetween. Vertical alignment films (not shown) were applied onto surfaces of the electrodes 4 and 6 to be provided with a pretilt angle of about 1 degree from a normal to the substrate. The direction of pretilt was set so that an inclination direction of liquid crystal molecules at the time of voltage application was 45 degrees with respect to an absorption axis of a polarization plate 1. Then, upper and lower two substrates 3 and 7 were applied to each other to form a cell, into which a liquid crystal material having a dielectric anisotropy (Δ ϵ) being negative (Model: "MLC-6608", mfd. by Merck & Co., Inc.) was injected as a liquid crystal material, whereby the liquid crystal 5 was aligned substantially homeotropically with respect to the substrate surface when a voltage was not applied thereto.

When such a liquid crystal display device was subjected to image display by variously changing a voltage, with respect to the respective RGB pixels, continuous gradation color can be obtained depending on an applied voltage, so that it became possible to effect complete full-color display with no image processing at all and it was possible to effect smooth natural picture display.

REFERENCE EXAMPLE 2

For comparison, an ECB-type active matrix liquid crystal display panel having a diagonal length of 12 inches and 600×800 pixels was used. A pixel pitch thereof was about 300 μm. Each pixel was not divided and a color filter was not used. A liquid crystal layer was adjusted to have a thickness of 11 μm so as to effect green display at the time of applying a voltage of ±5 V.

A cell structure is the same as that shown in FIG. 12.

Vertical alignment films (not shown) were applied onto surfaces of the electrodes 4 and 6 to be provided with a pretilt angle of about 1 degree from a normal to the substrate in a direction so that an inclination direction of liquid crystal molecules at the time of voltage application was 45 degrees with respect to an absorption axis of a polarization plate 1. Then, upper and lower two substrates 3 and 7 were applied to each other to form a cell, into which a liquid crystal material having a dielectric anisotropy (Δ ϵ) being negative (Model: "MLC-6608", mfd. by Merck & Co., Inc.) was injected as a liquid crystal material, whereby the liquid crystal 5 was aligned homeotropically with respect to the substrate surface when a voltage was not applied thereto.

When such a liquid crystal display device was subjected to image display by variously changing a voltage, with respect to the respective RGB pixels, continuous gradation color can be obtained depending on an applied voltage, the liquid crystal showed such a response that it did not respond to a voltage in the range from 0 V to 2 V and started to respond at a voltage value exceeding 2 V and caused a change in only brightness such that the display state was gradually brighten from black up to 2.5 V. When the voltage exceeded 2.5 V, a state in which a hue was changed was observed. Specifically, yellow display at 2.6 V, red display at 2.77 V, violet display at 2.85 V, blue display at 2.95 V, pale green display at 3.25 V, and green display at 5 V were effected.

As described above, it was confirmed that it was possible to effect white/black analog gradation display by the brightness change in the monochromatic area and multi-color display by the continuous hue change in the high voltage area.

EXAMPLE 1

Display was effected by using the same active matrix device as in Reference Example 2. At this time, dithering was performed by using the image processing method described in Basic Embodiment herein in order to effect natural picture display, whereby it was confirmed that it was possible to display natural picture (image) with less granulation.

EXAMPLE 2

An ECB-type active matrix liquid crystal display panel having a diagonal length of 12 inches and 600×800 pixels was used. A pixel pitch thereof was about 300 μm. Each pixel was divided into two portions provided with color filters of green and magenta, respectively. A liquid crystal layer was adjusted to have a thickness of 11 μm so as to effect blue display at the magenta color filter pixel at the time of applying a voltage of ±5 V.

A cell structure is the same as that shown in FIG. 12.

Vertical alignment films (not shown) were applied onto surfaces of the electrodes 4 and 6 to be provided with a pretilt angle of about 1 degree from a normal to the substrate in a direction so that an inclination direction of liquid crystal molecules at the time of voltage application was 45 degrees with respect to an absorption axis of a polarization plate 1. Then, upper and lower two substrates 3 and 7 were applied to each other to form a cell, into which a liquid crystal material having a dielectric anisotropy (Δ ϵ) being negative (Model: "MLC-6608", mfd. by Merck & Co., Inc.) was injected as a liquid crystal material, whereby the liquid crystal 5 was aligned substantially homeotropically with respect to the substrate surface when a voltage was not applied thereto.

When such a liquid crystal display device was subjected to image display by variously changing a voltage, with respect to the respective RGB pixels, continuous gradation color can be obtained depending on an applied voltage, continuous gradation was obtained with respect to monochromatic display of green, magenta, and their mixed color but only two-valued display was effected with respect to red and blue, so that natural picture display could not be effected.

On the other hand, when dithering was performed to effect display by using the image processing method described herein, it was possible to display natural picture (image) with less granulation, so that it was possible to effect display bearing even comparison with Reference Example 1.

EXAMPLE 3

An ECB-type active matrix liquid crystal display panel having a diagonal length of 12 inches and 600×800 pixels was used. A pixel pitch thereof was about 300 μm. Each pixel was divided into three portions provided with color filters of green and magenta, respectively. The pixel provided with the magenta color filter was divided at an areal ratio of 1:2. A liquid crystal layer was adjusted to have a thickness of 11 μm so as to effect blue display at the magenta color filter pixel at the time of applying a voltage of ±5 V.

A cell structure is the same as that shown in FIG. 12.

Vertical alignment films (not shown) were applied onto surfaces of the electrodes 4 and 6 to be provided with a pretilt angle of about 1 degree from a normal to the substrate in a direction so that an inclination direction of liquid crystal molecules at the time of voltage application was 45 degrees with respect to an absorption axis of a polarization plate 1. Then, upper and lower two substrates 3 and 7 were applied to each other to form a cell, into which a liquid crystal material having a dielectric anisotropy ($\Delta\epsilon$) being negative (Model: "MLC-6608", mfd. by Merck & Co., Inc.) was injected as a liquid crystal material, whereby the liquid crystal 5 was aligned substantially homeotropically with respect to the substrate surface when a voltage was not applied thereto.

When such a liquid crystal display device was subjected to image display by variously changing a voltage, with respect to the respective RGB pixels, continuous gradation color can be obtained depending on an applied voltage, continuous gradation was obtained with respect to monochromatic display of green, magenta, and their mixed color but only four gradation level display was effected with respect to red and blue, so that natural picture display could not be effected.

On the other hand, when dithering was performed to effect display by using the image processing method described herein, it was possible to display natural picture (image) with very less granulation, so that it was possible to effect display bearing even comparison with Reference Example 1.

INDUSTRIAL APPLICABILITY

As described hereinabove, according to the present invention, it becomes possible to realize natural picture display with less granulation by selecting at least any one of pieces of discrete output information used for dithering from analog gradation. Incidentally, in the embodiments of the present invention, only dithering, particularly Bayer-type ordered dithering is described but it is needless to say that the present invention is also applicable to other image processing methods such as error diffusion method, blue-noise mask method, and the like.

Further, in the above examples, the liquid crystal display device of a vertical alignment mode is principally described but the present invention is applicable to any mode so long as it is a mode, utilizing a change in retardation under voltage application, such as the homogeneous alignment mode, HAN mode, OCB mode, or the like. It is also possible to apply the above described liquid crystal alignment mode to such an alignment mode in which liquid crystal molecules are placed in a twisted alignment state as in the STN mode.

Further, similar effects as in the above described examples are achieved even by using such a mode as to change a spacing distance as a thickness of air as a medium of interference layer by mechanical modulation in place of the liquid crystal having the ECB effect. Further, it is also possible to attain the above described effects similarly as in the examples even when the particle movement-type display device having the above described constitution in which the plurality of particles as the medium are moved by voltage application is employed in the display apparatus of the present invention.

Further, in the Examples, as the color filter, a combination of those of green and magenta is described but the present invention is also applicable to a combination of those of red and cyan and a combination of those of blue and yellow.

The invention claimed is:

1. A display apparatus, comprising:

a display panel comprising a plurality of pixels exhibiting a brightness change range with respect to an applied voltage and a hue change range with respect to the applied voltage, and a control portion where a color image signal is inputted therein and a display signal is outputted to the display panel, wherein the control portion comprises signal generation means for generating and outputting a brightness display signal in the brightness change range, a hue display signal in the hue change range, and a signal for indicating a mixing ratio between the brightness display signal and the hue display signal, from the inputted color image signal, and wherein the display panel effects display, on the basis of the signal for indicating the mixing ratio, at a plurality of pixels in which pixels displaying in the brightness change range and pixels displaying in the hue change range are mixed.

2. A display apparatus according to claim 1, wherein the pixels exhibit a continuous brightness change range and a continuous hue change range with respect to the applied voltage, and wherein the signal generation means of the control portion is means for generating a continuous gradation display range in the brightness change range, a continuous gradation display signal in the hue change range, and a discrete signal for indicating a mixing ratio between these two signals, from the inputted color image signal.

3. A display apparatus according to claim 1, wherein the pixels exhibit a continuous brightness change range and a discontinuous hue change range with respect to the applied voltage, and wherein the signal generation means of the control portion is means for generating a continuous gradation display signal in the brightness change range, a discontinuous color display signal in the hue change range, and a discrete signal for indicating a mixing ratio between these two signals, from the inputted color image signal.

4. A display apparatus according to claim 1, wherein the pixels are provided with a color filter and exhibit a continuous brightness change range of a color of the color filter and a discontinuous hue change range with respect to the applied voltage, and wherein the signal generation means of the control portion outputs the continuous brightness display signal, a hue display signal at any value in the discontinuous hue change range, and a signal for indicating a mixing ratio between the brightness display signal and the hue display signal.

5. A display apparatus according to claim 1, wherein the pixels are provided with a color filter, a first subpixel exhibiting a continuous brightness change range of a color of the color filter and a discontinuous hue change range with respect to the applied voltage, a color filter of a color complementary to the color of the color filter at the first subpixel, and a second subpixel exhibiting a brightness change range of the color of the color filter with respect to the applied voltage, and wherein the control portion outputs the brightness display signal, a hue display signal at any value in the discontinuous hue change range, and a signal for indicating a mixing ratio between the brightness display signal and the hue display signal to the first subpixel and outputs a brightness display signal for a color complementary to magenta to the second subpixel.

6. A display apparatus according to claim 5, wherein the color of the color filter at the first subpixel is magenta, and the hue change range of the first subpixel is a discontinuous hue change range including blue and red.

7. An image forming apparatus, comprising:

signal generation means for generating and outputting a brightness display signal in the brightness change range, a hue display signal in the hue change range, and a signal for indicating a mixing ratio between the brightness display signal and the hue display signal, from the inputted color image signal, and means for forming a color image, on the basis of the signal for indicating the mixing ratio, by a plurality of pixels in which pixels displaying in the brightness change range and pixels displaying in the hue change range are mixed.

* * * * *

UNITED STATES PATENT AND TRADEMARK OFFICE

CERTIFICATE OF CORRECTION

PATENT NO. : 7,375,735 B2
APPLICATION NO. : 11/165168
DATED : May 20, 2008
INVENTOR(S) : Yasufumi Asao It is certified that error appears in the above-identified patent and that said Letters Patent is hereby corrected as shown below:

TITLE PAGE, ITEM [56] REFERENCES CITED:

FOREIGN PATENT DOCUMENTS, "3098112" should read --3-098112--.

COLUMN 1:

Line 16, "means" should read --means of--.

COLUMN 2:

Line 5, "motion" should read --a motion--.
Line 24, "in" (second occurrence) should read --is--.

COLUMN 3:

Line 48, "in" should read --in the--.

COLUMN 6:

Line 17, "slid" should read --solid--.
Line 30, "device" should read --devise--.
Line 53, delete "were".

COLUMN 16:

Line 23, "brighten" should read --brightened--.

Signed and Sealed this

Ninth Day of June, 2009

JOHN DOLL
*Acting Director of the United States Patent and Trademark Office*